US005149914A

United States Patent [19]

Koga et al.

[11] Patent Number: 5,149,914

[45] Date of Patent: Sep. 22, 1992

[54] DEVELOPMENT APPARATUS USING A FLEXIBLE MAGNETIC FIELD FORMING LAYER

[75] Inventors: Yoshiro Koga; Shizue Nakazawa; Takehiko Okamura, all of Suwa, Japan

[73] Assignee: Seiko Epson Corporation, Tokyo, Japan

[21] Appl. No.: 667,616

[22] Filed: Mar. 8, 1991

[30] Foreign Application Priority Data

| | | | |
|---|---|---|---|
| Mar. 9, 1990 | [JP] | Japan | 2-58321 |
| Mar. 9, 1990 | [JP] | Japan | 2-58322 |
| Mar. 9, 1990 | [JP] | Japan | 2-58323 |
| Mar. 9, 1990 | [JP] | Japan | 2-58324 |
| Mar. 9, 1990 | [JP] | Japan | 2-58325 |
| Mar. 9, 1990 | [JP] | Japan | 2-58328 |
| Mar. 9, 1990 | [JP] | Japan | 2-58329 |
| Mar. 9, 1990 | [JP] | Japan | 2-58332 |
| Mar. 9, 1990 | [JP] | Japan | 2-58333 |
| Mar. 9, 1990 | [JP] | Japan | 2-58334 |
| Mar. 9, 1990 | [JP] | Japan | 2-58335 |

[51] Int. Cl.[5] ..... G03G 15/09

[52] U.S. Cl. ..... 118/657; 355/251

[58] Field of Search ..... 355/251-253, 355/259; 118/653, 656, 657, 658; 430/122; 428/900; 29/132

[56] References Cited

U.S. PATENT DOCUMENTS

| | | | |
|---|---|---|---|
| 4,121,931 | 10/1978 | Nelson | 118/657 X |
| 4,331,101 | 5/1982 | Müller et al. | 118/658 |
| 4,564,285 | 1/1986 | Yasuda et al. | 355/259 X |
| 4,656,964 | 4/1987 | Kanno et al. | 118/653 X |
| 4,791,882 | 12/1988 | Enoguchi et al. | 118/653 |
| 4,851,874 | 7/1989 | Ogiyama | 118/657 X |

FOREIGN PATENT DOCUMENTS

| | | | |
|---|---|---|---|
| 0104958 | 6/1982 | Japan | 355/251 |
| 0119371 | 7/1984 | Japan | 355/251 |
| 19506 | 5/1985 | Japan . | |
| 0115971 | 6/1985 | Japan | 355/251 |
| 0249174 | 12/1985 | Japan | 355/251 |
| 0250375 | 12/1985 | Japan | 355/251 |
| 65579 | 3/1989 | Japan . | |
| 0219778 | 9/1989 | Japan | 355/251 |

*Primary Examiner*—A. T. Grimley
*Assistant Examiner*—William J. Royer
*Attorney, Agent, or Firm*—W. Douglas Carothers, Jr.; Gregory D. Ogrod

[57] ABSTRACT

A development member for use in a development apparatus for the transport of magnetic toner to develop a latent image formed on a latent image carrier having either an elastic layer or a membrane member in combination with a magnetic field forming layer, and may also include conductive or insulating layers or both. A conductive layer provides for a high resolution picture image by means of the development electrode effect. An insulating layer provides for control of the amount of charge on the toner being transported and its polarity. The development member may be in the form of a roller member or an endless belt-type member and positioned for rotational passage in proximity relative to or for pressure contact or engagement with the latent image carrier.

47 Claims, 12 Drawing Sheets

DEVELOPMENT APPARATUS USING A FLEXIBLE MAGNETIC FIELD FORMING LAYER

BACKGROUND OF THE INVENTION

This invention relates generally to a development apparatus that employs magnetic toner, and, more particularly, relates to development apparatus that develops an image by transporting single component magnetic toner utilizing a development member comprising a combination of an elastic or elastomeric layer and a magnetic field forming layer.

Development apparatus known in the art utilizes the single magnetic brush development method, and one such example is disclosed in U.S. Pat. No. 4,121,931. In this patent, the transport development roller member comprises a magnetic brush in the form of a magnetic roll formed on a nonmagnetic cylindrical sleeve, which is utilized to transport single component magnetic toner to perform image development on a image receptor member or latent image carrier. In another disclosure, Japanese patent 60-19506 discloses a development roller member comprising a nonmagnetic cylindrical center with an attached elastic conductive roller with an internal fixed or rotatable magnet for the transport of a single component magnetic toner wherein the development roller is placed in pressure contact with a latent image receptor or carrier.

Improvements over the years have been made on single component magnetic brush development systems and improved methods for development have been offered. One such improvement is disclosed in U.S. Pat. No. 4,564,285 wherein a transport development roller member comprises a nonmagnetic cylindrical sleeve with a magnetic roller formed internally of the sleeve, and a floating electrode is formed on its outer surface for the transport of single component magnetic toner resulting in enhanced picture quality of line images and solid images upon latent image development. Also, in Japanese laid open publication No. 59-119371, there is shown a development roller member comprising an insulating layer formed on a conductive base member with a plurality of dispersed minute electrodes formed on the surface of the insulating layer. Transport of single component magnetic toner by the development roller is accomplished with a magnetic field formed either in the insulating layer or in the dispersed electrodes and development of a latent image is accomplished by placing the development roller in engagement or contact with or in proximity to a latent image receptor or carrier. Further, U.S. Pat. No. 4,851,874 discloses a magnetic brush development roller for developing a latent image formed on an endless latent image receptor or carrier.

However, among these prior technologies employing magnetic toner development systems, albeit a single component magnetic brush development system or a conventional toner feed development system, the utilization of a development roller constructed of a cylindrical sleeve and an associated magnetic roller is complicated to fabricate, large in size and resulting in a costly component for use in image forming and reproducing apparatus. Further, because the threshold of miniaturization of the pole pitch is low, it is difficult with these development apparatus to form a thin and uniform toner layer on the surface of development roller. Since the leakage magnetic flux of the magnetic development roller cannot be sufficiently maintained on the development sleeve, a sufficiently high toner retention force cannot be maintained on the development sleeve causing toner scattering and image fogging in non-image portions. Also, there are many factors affecting picture quality deterioration, such as, nonuniform density of image toning and the formation of tails at the edges of the latent image caused from magnetic field variations in the magnetic development roller. Also, with respect to a development method that provides for the transport of toner in a thin layer on the surface of a magnetic development roller, deterioration in picture quality occurs in accordance with magnetic field variations over the magnetic roller. Also, the development apparatus of this type must be made larger in order to accommodate a latent image receptor or carrier of the endless belt type.

Also, the latter examples of prior technology relating to floating electrode structures have the problem in that it is difficult to form an insulation layer with minute magnets dispersed throughout its surface so that the cost of manufacturing are high. Also, since the magnetic force applied to the toner layer formed on the roller will be nonuniform, transported toner that is uncharged or having polarity different from normal polarity is developed, i.e., deposited also in the non-image portions of the latent image on the latent image carrier, which is known in the art as "fogging". While toner deposited in the non-image areas is not generally transferred to the recording medium, such as, in electrophotography, such deposited toner represents unnecessary waste, which is not only uneconomic, but also requires the use of a large waste toner container in the development apparatus increasing the overall size of the image forming apparatus. In addition, even when charged toner having normal polarity contacts the latent image carrier, toner whose amount of charge is relatively large compared to the unit bulk charge results in adherence to the non-image portions because of the mirror image force and becomes a principal cause of fogging that also remains on the recording medium.

In another aspect relative to the design of development apparatus of the prior art, there is known in Japanese laid open publication 64-65579 the use of a tubular membrane member rotatably supported on a drive roller wherein the membrane member has an ID larger than the OD of the drive roller so that the membrane member possesses surplus peripheral length relative to its drive roller. However, with this particular development apparatus design, there are difficulties in rendering the amount of transported toner uniform because the force that retains the toner on the development member depends on both the electrostatic image force and the adhesive force holding the transported toner. Also, when the toner is developed on a latent image carrier, such as, a light sensitive member or photoreceptor, uncharged toner and toner whose polarity is not normal or proper are deposited in the non-image portions, and, as a result, the only images that could be produced are those with highly conspicuous fogging, i.e., the state where toner adheres to the non-image portions, on the latent image carrier. Although images without fogging were obtained on the recording medium because only normal polarity toner was transferred to the recording medium, a substantial part of toner is not transferred to develop the latent image and, therefore, is unnecessarily wasted, which is not only uneconomical, but also requires sufficient amount of dedicated space in the waste toner receptacle resulting in larger overall size for the image forming apparatus.

Thus, it is an object of this present invention to provide development apparatus having a development member that provides for enhanced development of latent images on latent image carriers utilizing single component magnetic toner with little nonuniformity in variation in image density and without fogging effects by providing for stabilized transport of uniform amounts of toner by the toner development member.

Another object of this invention is the provision of a toner development apparatus having at least a combination elastic layer and magnetic field forming layer which are elastically displaceable and improve image quality and development properties.

A further object of this invention is the provision of a toner development apparatus that provides for enhanced picture quality having high resolution.

Another object of this invention is the provision of a toner development apparatus of simple construction, smaller size and reduced cost.

SUMMARY OF THE INVENTION

According to this invention, a development member is provided in a development apparatus for use in an image forming apparatus for the transport of single component magnetic toner to develop a latent image formed on a latent image carrier comprises, at a minimum, a combination of either an elastic layer or a membrane member and a magnetic field forming layer. Also, the development member combination may also include a conductive layer or an insulating layer or both such layers. The conductive layer provides for a high resolution picture image by means of the development electrode effect. The insulating layer provides for control the charge polarity of and the amount of charge on the toner transported by the development member. The develoment member may be in the form of a roller member or an endless belt-type member and positioned for rotational passage in proximity relative to the latent image carrier or positioned for pressure contact or engagement with the latent image carrier.

Since the development member comprising this invention transports a thin layer of toner in the vicinity of or in proximity to the magnetic field forming layer of the development member comprising a single body, the development member is not only simplified in its construction compared to prior art apparatus, but also is smaller in size, lighter in weight and lower in manufacturing cost. Also, the structure of the development member permits the formation of a minute magnetic pitch in its thin magnetic field forming layer so that a uniformly applied, thin layer of toner may be created on the development member due to a more uniformly created magnetic field. As a result, it is possible to reduce nonuniformities in image density caused from variations in the established magnetic field and variations in the toner layer thickness, regardless if the contact type or non-contact type of development is employed.

In one embodiment of the development member comprising this invention, the development apparatus is provided with a novel development member in the form of a roller for the transport of single component magnetic toner to develop a latent image formed on a latent image carrier wherein the development member minimally comprises an elastic layer and a magnetic field forming layer. Preferably, the elastic layer may have a modulus of elasticity relative to rubber hardness under 70 degress and a layer thickness over 0.5 mm. Also, preferably, the surface roughness of the development layer, i.e., the outer most layer of the development member, is smaller than the smallest magnetic reverse interval of the magnetic field forming layer and is smaller than the bulk means particle diameter of the single component magnetic toner. Because the surface roughness of the development member is smaller than the smallest magnetic reverse interval, it is possible to create a magnetic force that brings about uniformity of the toner on the development member while providing a more stable, thin toner layer with sufficient retention force at the point of image development thereby reducing foggin effects. Because the surface thickness of the development member is smaller than the bulk mean particle diameter of the toner, it is possible to prevent toner residence on the development member and to transport the toner under a stable charge condition. As a result, it is possible to provide high resolution development by magnetizing the thin magnetic field forming layer to have a minute magnetic pitch which correspondingly permits the formation of a uniformly created thin toner layer or thin magnetic brush layer at a minute pitch on the development member. Thus, foggin in non-image portions and nonuniformity in image densities due to variations in toner thickness on the development member and variations in the established magnetic field in the development member are substantially reduced permitting high resolution development to be realized.

Also, by utilizing contact type development with a thin layer of toner, the development electrode effect may be maximized to its fullest potential resulting in high resolution images. Further, due to the retention of the toner on the development member by a magnetic force having a minute pitch, the amount of waste toner generated during the development process will be significantly decreased as well as a decrease in image smudges caused from toner scattering, which translates into reduced operating costs and maintenance of the image formation apparatus.

In another embodiment of the development member comprising this invention, the development apparatus is provided with a novel development member comprising a resilient tubular shaped membrane member which is applied over the surface of and driven by a drive roller through frictional engagement with the drive roller. The inner surface of the tubular membrane member frictionally engages a portion of the outer surface of the drive roller and is spatially separated from the drive roller at the point of proximity with the latent image carrier at the development region formed between the latent image carrier and the development member. Development of a latent image for on an image carrier in an image forming apparatus is carried out by having the development membrane member in proximity to the latent image carrier or in pressure contact with the latent image carrier. By providing a conductive layer in the construction of the membrane member, it becomes possible to achieve a developed image having high resolution by employing the conductive layer is a development electrode. Also, by providing an insulation layer in the construction of the membrane member, it becomes possible to stabilize the frictional or triboelectrical charge between the membrane member and the toner and to reduce variations in development densities over time.

The development member of this embodiment minimally comprises a tubular membrane member and a drive roller that contacts at least a portion of the inner surface of the tubular membrane member when driving the membrane member. The membrane member includes at least a thin magnetic field forming layer to provide a magnetic flux field for the adherence of toner to the surface of the development member. Also. surface roughness of the development member is preferably provided to be smaller than the smallest magnetic reverse interval of the magnetic field forming layer and smaller than the bulk mean particle diameter of the single component toner.

With respect to another aspect of this invention relative to both of the foregoing embodiments, it is preferred that the ratio value $V_d/V_p$, which is the ratio between the circumferential velocity, $V_d$, of the development member and the circumferential velocity, $V_p$, of the latent image carrier, be greater than 1 but less than 5 and, further, that the smallest magnetic reverse interval of the magnetic field forming layer be below 500 μm. As a result, a sufficient amount of transported toner will be maintained for producing good image density while, on the other hand, there will be a decrease in tails, i.e., the adherence of unnecessary toner to image end portions of the developed latent image and a decrease in fogging, i.e., the phenomenon of toner adhering to the non-image portions of an image caused by transport of an excessive amount or more than required amount of toner by the development member.

With respect to another aspect of this inventon relative to both of the foregoing embodiments, and wherein $V_b$ is the development bias applied between the latent image carrier and the development member, the electrical potential, $V_1$, of the image portion and the electrical potential, $V_2$, of the non-image portion on the latent image carrier are regulated to satisfy expression, $$\frac{|V_1 + V_2|}{2} \leqq |V_b| \leqq |V_2|.$$

The employment of this relationship is particularly useful in connection with development apparatus of the contact type.

With respect to another aspect of this invention relative to both of the foregoing embodiments, an alternating electric field is provided in the development region together with the development bias, $V_b$, and the frequency and peak electrical potential of the development bias may be varied to provide bivalent images having gradations with improved image contrast.

The embodiments of the development members of this invention are not only of simpler design, but also provide for development apparatus smaller size and reduced manufacturing complexity and costs. Also, the development members permit the utilization of a smaller magnetic pitch in the utilization of a thin magnetic field forming layer and, correspondingly, permits the forming of a uniformly distributed thin layer of toner on the development member. As a result, a decrease in nonuniform image densities caused by variations in toner layer thickness and a decrease in fogging due to enhanced retention of the toner on the development member via an improved magnetic field can be realized leading to high print quality development at high resolutions. Further, there is a decrease in contamination from toner scattering because of the enhanced magnetic retention force and a decrease in developed image tails, fogging and wasted transport of toner resulting in lower operation cost and maintenance of the image formation apparatus.

Also, by utilizing the construction of the development members of this invention. it is possible to bring about high print quality development at high resolutions without causing fogging even though the development is accomplished by pressure contact of an elastic member of a membrane member against a latent image carrier.

Other objects and attainments together with a fuller understanding of the invention will become apparent and appreciated by refering to the following description and claims taken in conjunction with the accompanying drawings.

DESCRIPTION OF THE PREFERRED EMBODIMENTS

Figure 1:
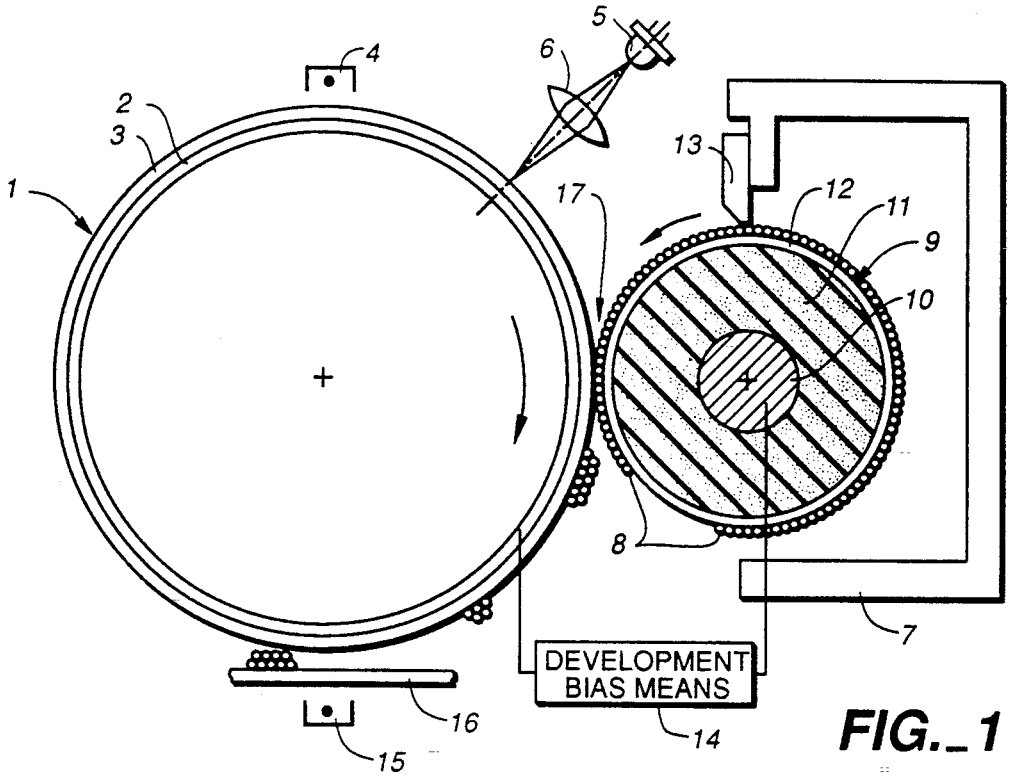
FIG. 1 is a side elevation of an image forming apparatus employing one embodiment of the development apparatus of this invention.

FIG. 1 is a side elevation of an image forming apparatus employing one embodiment of the development apparatus of this invention. The image forming apparatus comprises a latent image receptor or carrier 1 having light sensitive or photoreceptor layer 3 of organic or inorganic photoconductive material, which is applied as a film onto conductive support 2. Light sensitive layer 3 is charged employing charging device 4, such as, a corotron or a charging roller. Light emerging from light source 5, such as, a laser or LED source, passes through imaging optical system 6 and is irradiated onto light sensitive layer 3 selectively in correspondence with the image, i.e., in imagewise formation, achieving an electrical potential contrast over the charged surface of layer 3 forming an electrostatic latent image.

Development apparatus 7 comprises a development member 9 in the form of a roller which transports magnetic toner 8 to the region of image carrier 1 at development region 17. Development roller 9 is a laminated structure and is installed on drive shaft 10 and includes at least two concentric layers which are elastic or elastomeric layer 11 and magnetic field forming layer 12. Elastic layer 11 may be comprised of carbon black dispersed in foamed urethane rubber. Magnetic field forming layer 12 may be about 10 $\mu$m thick and formed by coating a magnetic paint containing $\gamma$-$Fe_2O_3$ dispersed in a binder solution. Magnetic toner 8 is retained on development member 9 by the leakage magnetic flux at the outer periphery of magnetic field forming layer 12. Development roller 9 is rotated in a counterclockwise direction past blade member 13, which regulates or meters the amount of toner retained on the surface of roller 9 whereby a thin toner layer is transported on the surface of roller 9 at a velocity of $V_d$. Blade member 13 may be constructed of non-magnetic or magnetic metal or a resin. When toner 8 is transported to development region 17 in proximity to latent image carrier 1, a development electrical field is formed at region 17 by means of development bias means 14 and, as a result, toner 8 adheres to latent image carrier 1 in response to the development electrical field and a latent electrostatic image formed on the carrier is developed with toner. Further, employing transfer device 15, which may be a corotron or a transfer roller, the developed latent image is transferred onto recording medium 16, such as paper, and the toner image is fused to recording medium 16 by means of heat and pressure to secure the image on the recording medium.

When 600 DPI line latent images and character latent images and solid latent images were formed continuously for 10,000 pages using a development apparatus as shown in FIG. 1, with the electrostatic latent image on latent image carrier 9 having an electrical potential $V_1 = -100$ V in the image portion and having an electrical potential $V_2 = -600$ V in the non-image portion and with development bias $V_b = -400$ V, 600 DPI line stable images were formed without line expansion, the images contained no fogging or tails at image end portions, and high density, stable solid images with OD values over 1.4 can be satisfactorily produced.

Figure 2:
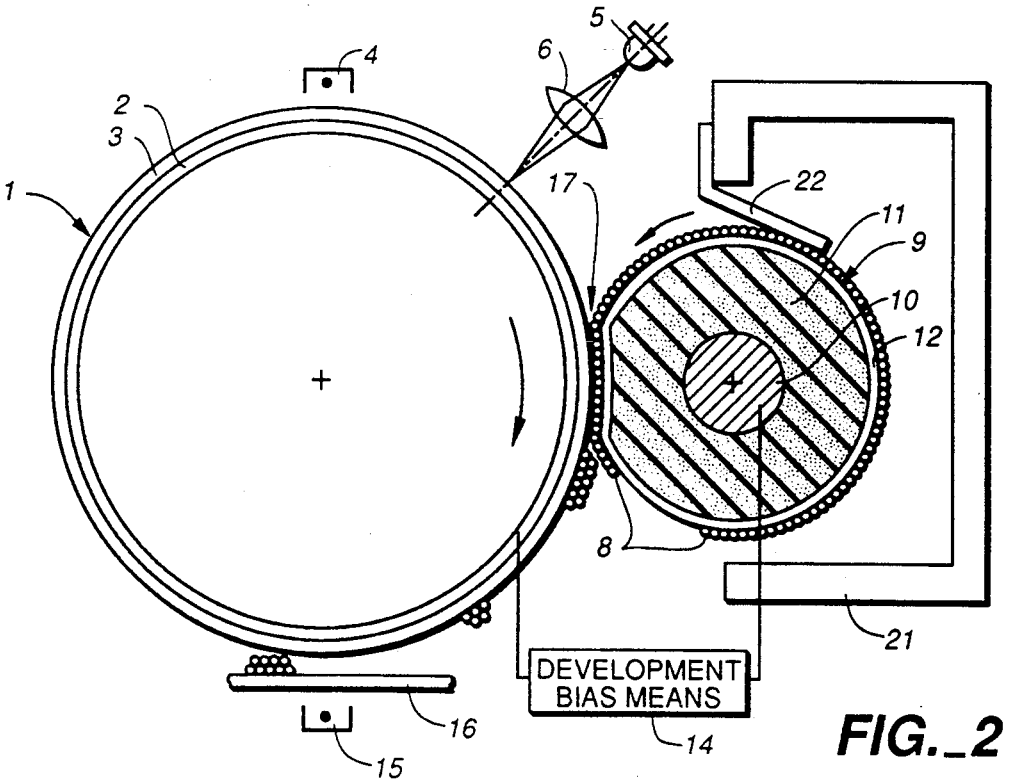
FIG. 2 is a side elevation of an image forming apparatus employing another embodiment of the development apparatus of this invention.

FIG. 2 is a side elevation of an image forming apparatus employing another embodiment of the development apparatus of this invention. Elements in FIG. 2 identical to corresponding elements in FIG. 1 carry the same numerical identification so that the description thereof is equally applicable to the image forming apparatus of FIG. 2. Development apparatus 21 includes a development member 9 for the rotational transport of a thin layer of magnetic toner 8 to image carrier 1 for the development of a latent electrostatic image. Development roller 9 retains magnetic toner 8 on its surface by means of the leakage magnetic flux created by magnetic field forming layer 12. The layer of toner 8 on the surface of development roller 9 is formed into a thin, uniform layer by elastic blade member 22 which is constructed of a thin sheet of nonmagnetic or magnetic metal or resin. In this embodiment, development roller 9 is in pressure contact with latent image carrier 1 under a predetermined amount of pressure. When toner 8 on development member 9 is transported to the point of pressure contact with latent image carrier 1 at development region 17, a development electrical field is formed at region 17 by means of development bias means 14 and, as a result, toner 8 adheres to latent image carrier 1 in response to the development electrical field and a latent electrostatic image formed on the image carrier 1 is development with toner. Further, employing transfer device 15, the developed image is transferred onto recording medium 16 and the toner adhering to the recording paper is fused to the medium by means of heat and pressure to achieve a permanent image on the recording medium. As an example of the amount of pressure for pressure contact of development member 9 onto latent image carrier 1 to maintain a stable development state, pressure is uniformly applied at a force of about 1 kgf.

When 600 DPI line latent images and character latent images and solid latent images were formed continuously for 10,000 pages employing the development apparatus of FIG. 2, with the electrostatic latent image on latent image carrier 9 having an electrical potential $V_1 = -50$ V in the image portion and having an electrical potential $V_2 = -450$ V in the non-image portion and with development bias $V_b = -250$ V, and wherein the smallest magnetic reverse interval of the magnetic field forming layer 12 was about 80 μm, it was possible to form in a stable manner 600 DPI line images without line expansion. Also, the images contained no fogging or tails at image end portions, there was no excess toner in facing image end portions, and high density solid images with OD values over 1.4 could be formed in a stable manner. Further, it was possible to greatly decrease the amount of waste toner left from the development process with no corresponding fogging on the recording medium since there was no fogging relative to the developed image on latent image carrier 1.

Figure 3:
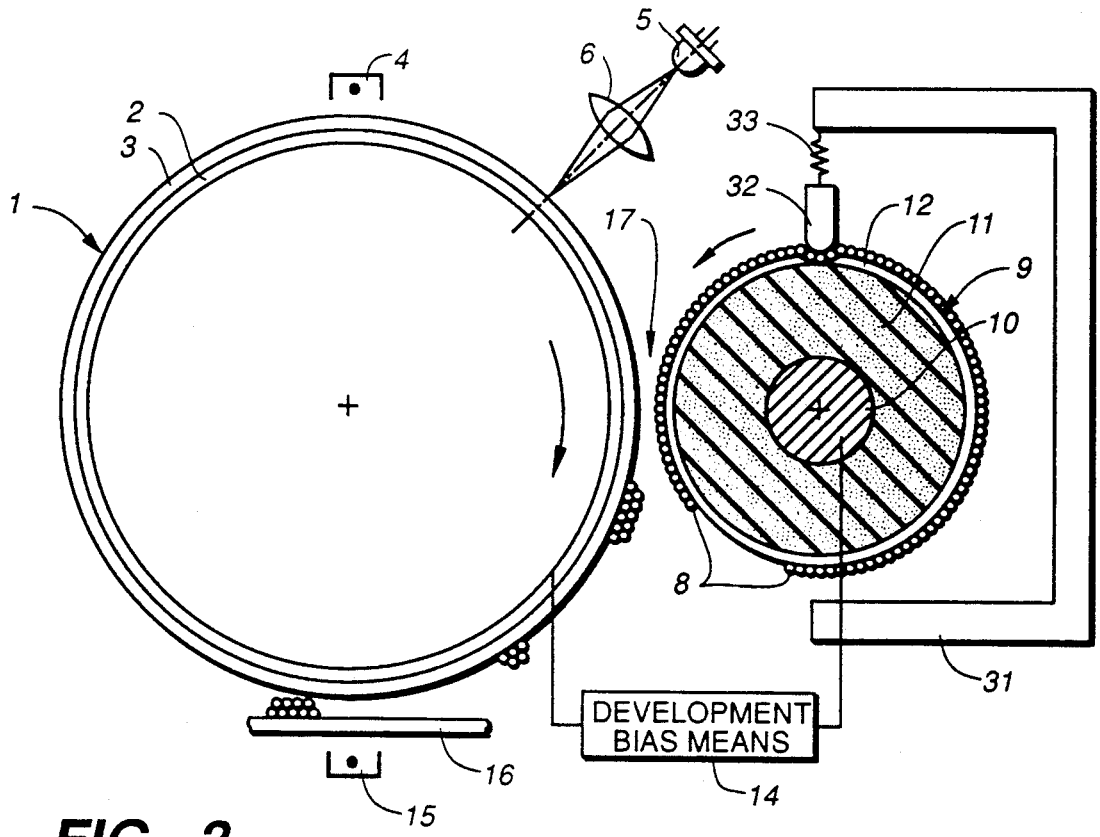
FIG. 3 is a side elevation of an image forming apparatus employing another embodiment of the development apparatus of this invention.

FIG. 3 is a side elevation of an image forming apparatus employing another embodiment of the development apparatus of this invention. Elements in FIG. 3 identical to corresponding elements in FIG. 1 carry the same numerical identification so that the description thereof is equally applicable to the image forming apparatus of FIG. 3. Development apparatus 31 includes a development member 9 for the rotational transport of a thin layer of magnetic toner 8 to image carrier 1 for the development of a latent electrostatic image. Development roller 9 retains magnetic toner 8 on its surface by means of the leakage magnetic flux created by magnetic field forming layer 12. The layer of toner 8 on the surface of development roller 9 is formed into a thin, uniform layer by blade member 32, which is constructed of nonmagnetic or magnetic metal or resin and is in pressure contact against development roller 9. Blade member 32 is suspended by a spring means 33 to apply a force against the surface of development member 9. Development roller 9 is arranged relative to carrier 1 to provide a spatial gap at development region 17 wherein the gap has a width that is greater than the thickness of toner 8 formed on development member 9. When toner 8 is transported to the position of development region 17 where latent image carrier 1 and development member 9 are in close proximity, a development electrical fiel is formed at region 17 by means of development bias means 14 and, as a result, toner 8 adheres to latent image carrier 1 in response to the development electrical field and a latent electrostatic image formed on the image carrier 1 is developed with toner. When the image formation apparatus of FIG. 3 was continuously used to form 600 DPI line images and character images and solid images on 10,000 pages of recording medium, it was possible to form 300 DPI line images in stable manner without line spread or expansion of line images, there were no tails or fogging occurrence at image end portions, the solid images were formed in a stable manner at high densities over OD value 1.4. Further, it was possible to greatly decrease the amount of waste toner left from the development process with no corresponding fogging on the recording medium since there was no fogging created relative to latent image carrier 1.

In FIGS. 1-3, elastic layer 11 is constructed of materials, such as, natural rubber, silicone rubber, urethane rubber, butadiene rubber, chloroprene rubber and NBR. The physical form of elastic layer 11 may be, such as, rubber, foam or sponge. While the layer thickness of elastic layer 11 will vary depending on the method of development employed and the method used to regulate the amount of transported toner on its surface, its thickness is preferably over 0.5 mm in order that sufficient elastic displacement can be achieved. Also, magnetic field forming layer 12 may be formed on the surface of layer 11 by coating a magnetic paint on its surface. The magnetic paint may be made by dispersing magnetic powders, known as magnetic recording materials or magnetic materials, in a binder solution together with various additives. More particularly, such materials preferably contain at least one of Fe, Ni, Co, Cr and Mn, e.g., $\gamma$-$Fe_2O_3$, Ba-Fe, Ni-Co, Co-Cr and Mn-Al. The thickness of the film 12 should be below 100 μm so that the occurrence of nonuniform toner density can be reduced resulting in a uniform, thin layer of toner with the smallest magnetic reverse pitch under 100 μm, while suppressing variations in the amount of toner transported on development member 9 because of magnetic brush formation, i.e., variations due to the standup nature of toner chains at magnetic poles and lying nature of toner chains between magnetic poles. In particular, by making the thickness of layer 12 below 100 μm, preferably about 10 μm, and by making the smallest magnetic reverse pitch under 500 μm, preferably around 100 μm, whether applied magnetization is horizontal or vertical, it is possible to suppress variations in the amount of toner transported on development member 9 while simultaneously providing a uniformly thin layer of toner 8 thereby decreasing the occurrence of nonuniform image densities.

Also, if the velocity ratio between peripheral velocity, $V_d$, of development member 9 and peripheral velocity, $V_p$, of latent image carrier 1 is $1 \leqq V_d/V_p$, it is possible to supply a sufficient amount of toner to latent image carrier 1 to form a high density image. Also, if $V_d/V_p \leqq 5$, it is possible to eliminate disarrays formed in images caused by differences in the relative velocities of latent image carrier 1 and the supplied toner 8 transported on roller 9. The resulting effect is that there is a decrease in tails caused by adhesion of toner on the end portions of characters and fine line portions of the image. Further, it becomes possible to retain toner 8 on development member 9 by means of the magnetic flux force even when considerably large and unnecessary amounts of toner 8 are supplied to latent image carrier 1 on development member 9. Lastly, images are developed having a high area gradations with little fogging on the non-image portions.

Toner 8 employed in this invention may be any known single component magnetic toner of either a resin type or a wax type. The composition of the developer, as is well known in the art, will be made by adding magnetic powders or colorants or external additives or other additives to a resin, and it may be accomplished by, for example, the pulverization method or the polymerization method.

It should be noted that the present invention is not restricted specifically to the constructions shown in FIGS. 1-3. Also, although the arrows in FIGS. 1-3 designate the rotational directions of the respective members, this invention is not limited to those particular combinations of rotational directions. Further, the development method employed can, of course, be either ordinary development or reversal development.

FIGS. 4-9 illustrate particular layer constructions for development member 9 comprising this invention.

Figure 4A:
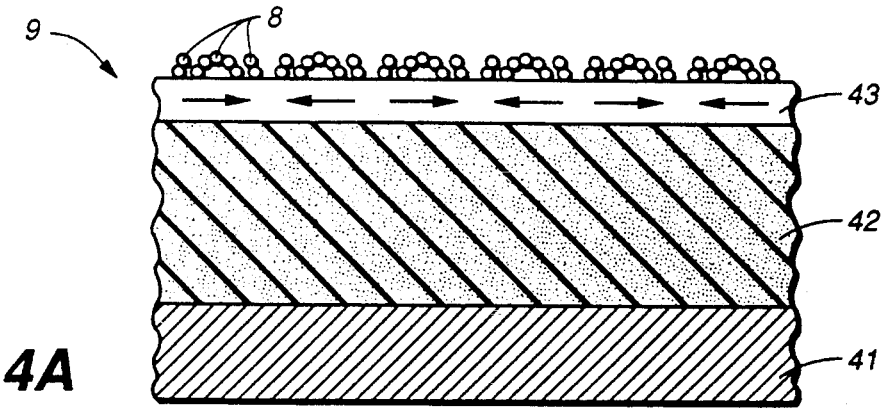
FIG. 4A is a cross sectional view showing the layer construction of the development member relative one example of the present invention.
Figure 4B:
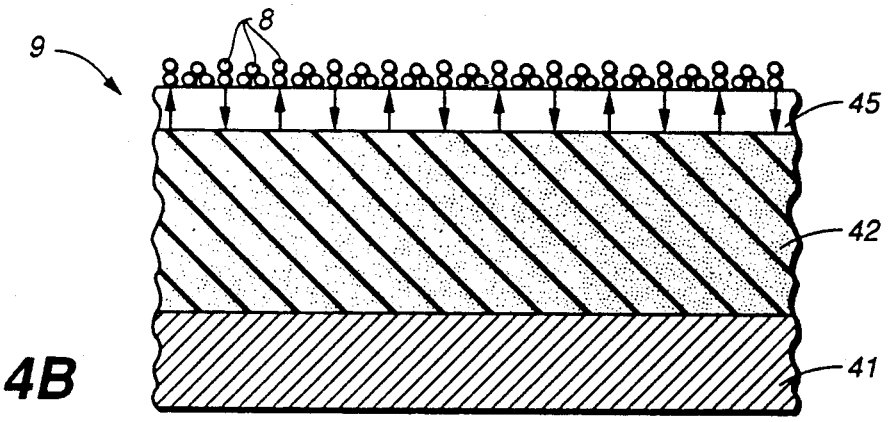
FIG. 4B is a cross sectional view showing the layer construction of development member relative to another example of the present invention.

FIG. 4A is a cross sectional view showing the layer construction of development roller or member 9 in one example of the present invention wherein elastic or elastomeric layer 42 comprising primarily an elastic resin is formed on base member 41, which may be a shaft. Magnetic field forming layer 43 is then formed on elastic layer 42 to complete the development member construction. Magnetic field forming layer 43 is magnetized in the horizontal direction so that the magnetic reverse pitch is under 100 μm thereby forming a series of minute toner chains from toner 8 on magnetic field forming layer 43 producing a thin and stable toner layer as illustrated in FIG. 4A. Also, by dispersing conductive material, such as, carbon black, in elastic resin when forming elastic layer 42, it is possible to achieve high resolution images by the application of a development bias voltage on elastic layer 42 to also increase the development electrode effect. Further, as shown in FIG. 4B, by magnetizing magnetic field forming layer 45 in the vertical direction, as shown by the arrows, it is possible to make the magnetic reverse pitch up to approximately the particle diameter of toner 8, for example, about 10 μm. Also, it is possible to achieve a single thin and uniform layer of toner 8 because a strong magnetic field is obtained at the surface of the magnetic field forming layer 45. Thus, it is, therefore, possible to decrease the magnetic powder content rate of toner 8 and increase the flexibility of toner manufacturing specifications and ease of its manufacture. In the example of development member 9 in FIG. 4B, by forming soft magnetic material on the back surface of magnetic field forming layer 45 to form a magnetic path, it becomes possible to achieve a stronger magnetic field on the surface of magnetic field forming layer 45.

Thus, an important aspect of this invention is employment of micro pitch magnetization with member 9 comprising a flexible magnetic field forming layer and an elastic layer. Thus, development is enabled providing a sufficient development electrode effect in pressure development employing a flexible magnetic field forming layer as well as enabling the stable transport of a thin layer of toner employing sufficient magnetic retention force as enabled by the magnetic brush phenomenon. Similar results are also achieved with contact and non-contact development.

Figure 5:
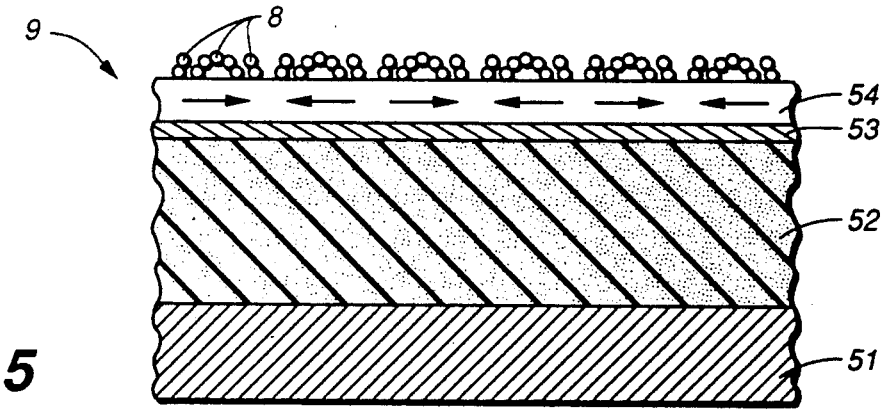
FIG. 5 is a sectional view of another example of the development roll member that may be employed with this invention.

FIG. 5 is a sectional view of another example of development member 9 that may be employed with this invention. Elastic layer 52 comprises foamed resin formed on base member 51, such as, a shaft. Conductive layer 53 is formed on elastic layer 52 and magnetic field forming layer 54 is formed on conductive layer 53 to complete the construction of development member 9. By magnetizing magnetic field forming layer 54 in the horizontal direction so that the magnetic reverse pitch is under 100 μm, minute toner chains of toner 8 are formed on magnetic field forming layer 54, as illustrated in FIG. 5, resulting a thin and uniform toner layer on the surface of development roll member 9. Consequently, it is possible to obtain a high resolution image by applying a development bias voltage on conductive layer 53 to raise the development electrode effect. The material of conductive layer 53 may be material containing a conductive metal, such as, Al or Ni, and, in addition, may be conductive material, such as, carbon black. Also, it is possible to form conductive layer 53 by means of an adhesive process or formed by coating or plating the material onto base member 51. While the arrows in FIG. 5 indicate the direction of magnetization to be in the horizontal plane, magnetic field forming layer 54 may also be prepared as a vertically magnetized film.

Figure 6:
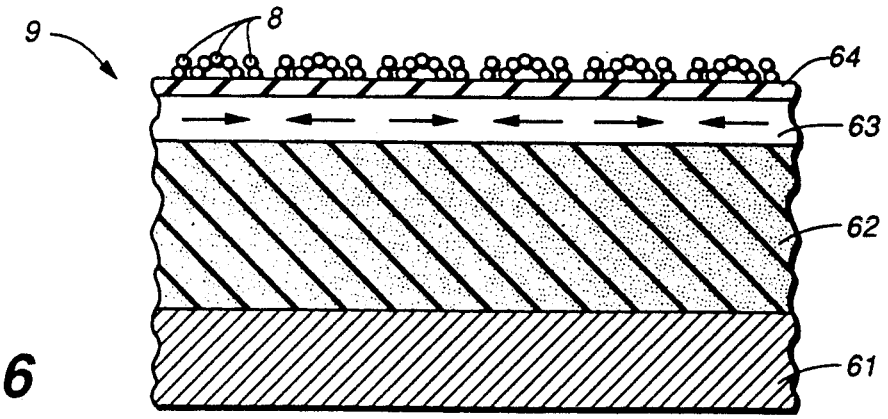
FIG. 6 is a sectional view of another example of the development member that may be employed with this invention.

FIG. 6 is a sectional view of another example of development member 9 that may be employed with this invention. Elastic layer 62 comprises sponge resin material and is formed on base 61, such as, a shaft. Magnetic field forming layer 63 is formed on elastic layer 62 followed by conductive layer 64 formed on magnetic field forming layer 63 to complete the structure of development member 9. By magnetizing magnetic field forming layer 63 in the horizontal direction with a fine magnetic reverse pitch under 100 μm, minute toner chains of toner 8 are formed on magnetic field forming layer 63, as illustrated in FIG. 6, resulting a thin and uniform toner layer on the surface of development roll member 9. Consequently, it is possible to obtain a high resolution image by applying a development bias voltage on conductive layer 64 to raise the development electrode effect. When conductive layer 64 is formed of a metal film that includes either Ni or Cr, conductive layer 64 functions as a protective film for magnetic field forming layer 63 increasing the longevity of development member 9. While the arrows in FIG. 5 indicate the direction of magnetization to be in the horizontal plane, magnetic field forming layer 63 may also be prepared as a vertically magnetized film.

Relative to another aspect of the embodiment shown in FIG. 6, elastic layer 62 may comprise a suitable elastic resin material as its primary ingredient as formed on base member 61. The surface roughness or texture of conductive layer 64, which is in surface contact with toner 8 on the development member, is adapted to be sufficiently smaller than the smallest magnetic reverse interval of magnetic field forming layer 63, which, for example, may be about 80 μm, so that the thin layer of toner 8 will not become nonuniform due to the surface roughness of development member 9. The surface roughness is below the bulk mean particle diameter of toner 25, which is about 10 μm, and, preferably, on the order of ½ the bulk mean particle diameter, in order to prevent toner 8 from adhering to conductive layer 64. The contact area between toner 8 and conductive layer 64 is sufficiently maintained in order to achieve an increase in the frictional or triboelectrical chargeability of toner 8 resulting in more stable retention of the toner on the surface of the development member. Thus, by means of this type of layer construction of development roller 9, it is possible to apply development bias voltage to conductive layer 64 to enhance the development electrode effect resulting in images of higher resolution.

The foregoing surface roughness aspect is not limited to a conductive surface such as conductive layer 64 but is also applicable to top layers on member 9 comprising, for example, magnetic field forming layer 54 in FIG. 5 or insulating layer 74 in FIG. 7, discussed below.

Relative to a further aspect of the embodiment of FIG. 6 as applied to the image forming apparatus of FIG. 2, where a thin layer of toner 8 is formed uniformly on the surface of development member 9 with the smallest magnetic reverse interval of the development member below 500 μm, e.g. illustrated at about 80 μm in FIG. 6, it is possible to increase the reproducibility of isolated dots and the reproducibility of fine lines which result from transportation nonuniformities in toner 8. As a result, nonuniform toned densities are almost indistinguishable by the human eye. However, when the smallest magnetic reverse interval is over 500 μm, for example 1,000 μm, nonuniform densities in the solid image portions will be clearly discernable by the human eye and, as a result, it will be difficult to reproduce image tones because the number of area gradations in a design matrix of 4 vertical dots and 4 horizontal dots will only be eight different tones or less. When a layer construction as shown in FIG. 6 is adopted, it will be possible to form high density solid images of OD values over 1.4 and high resolution line images of 600 DPI over the entire range of $1 \leqq V_d l/V_p \leqq 5$.

Figure 7:
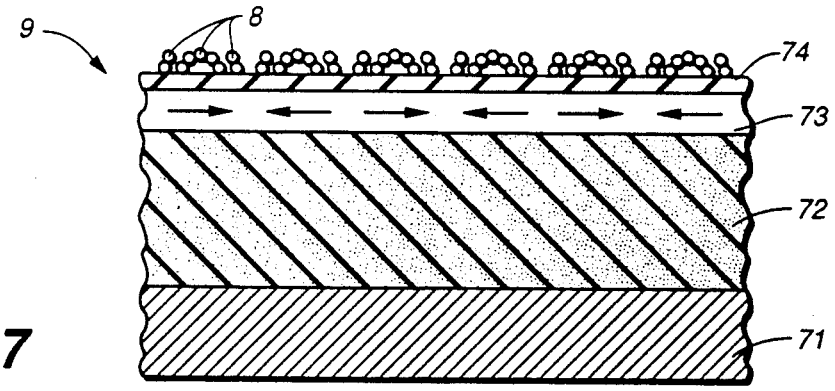
FIG. 7 is a sectional view of another example of the development member that may be employed with this invention.

FIG. 7 is a sectional view of another example of development member 9 that may be employed with this invention. Elastic layer 72, comprising a elastic resin, is formed on base member 71, such, as a shaft. Magnetic field forming layer 73 is formed on elastic layer 72 and insulation layer 74 is formed on magnetic field forming layer 73 to complete the construction of development member 9. In the same manner as described in previous examples, minute toner chains of toner 8 are formed on magnetic field forming layer 74, as illustrated in FIG. 7 resulting a thin and uniform toner layer on the surface of development roll member 9. By furnishing insulation layer 74 in a position at the outer periphery of member 9 to be in contact with toner 8, it becomes possible to control the charge polarity of and the amount of charge on toner 8 by choosing the insulative material triboelectrically. Also, employing resin of superior friction resistance, such as, fluorine resin, makes it possible to provide a protection layer on magnetic field forming layer 73. While the arrows in FIG. 7 indicate the direction of magnetization to be in the horizontal plane, magnetic field forming layer 74 may also be prepared as a vertically magnetized film.

Figure 8:
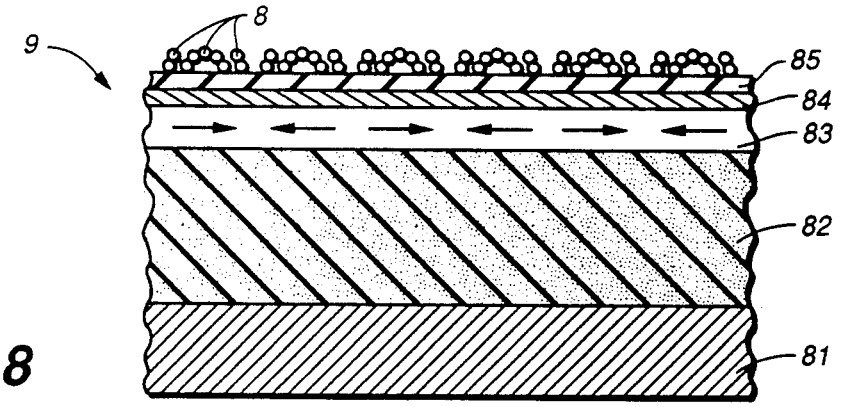
FIG. 8 is a sectional view of another example of the development member that may be employed with this invention.

FIG. 8 is a sectional view of another example of development member 9 that may be employed with this invention. Elastic layer 82, comprising and elastic resin, is formed on base member 81, such as, a shaft. Magnetic field forming layer 83 is formed on elastic layer 82, conductive layer 84 is formed on magnetic field forming layer 83 and insulation layer 85 is formed on conductive layer 84 to complete the construction of development member 9. In the same manner as described in connection with previous examples, a minute toner chain of toner 8 is formed on magnetic field forming layer 83, as illustrated in FIG. 8, resulting a thin and uniform toner layer on the surface of development roll member 9. Consequently, when the development bias is applied to conductive layer 84 and the development electrode effect is raised, it is possible to achieve a high resolution image. By providing insulation layer 85 at the position of contact with toner 8, it becomes possible to control the charge polarity of and the amount of charge on toner 86 by choosing the insulative material triboelectrically. Also, the employment of a resin of superior friction resistance, such as, fluorine resin, in insulation layer 85 makes it possible to provide a protection layer for magnetic field forming layer 84 and makes it possible to maintain a stable development electrode effect. While the arrows in FIG. 8 indicate the direction of magnetization to be in the horizontal plane, magnetic field forming layer 83 may also be prepared as a vertically magnetized film.

Figure 9:
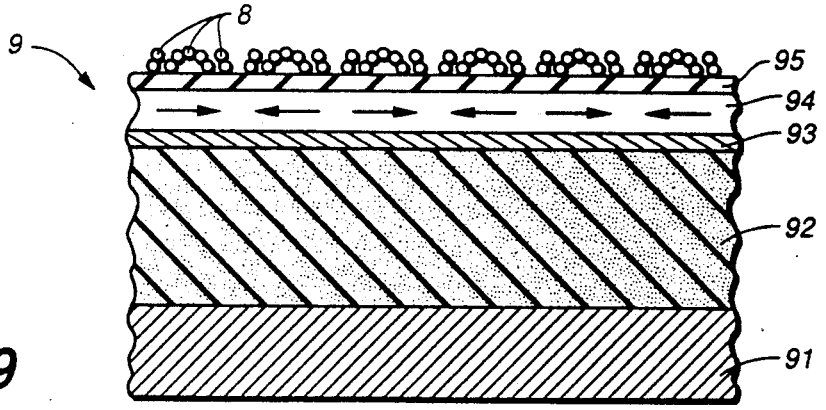
FIG. 9 is a sectional view of another example of the development member that may be employed with this invention.

FIG. 9 is a sectional view of another example of development member 9 that may be employed with this invention. Elastic layer 92 comprises an elastic resin and is formed on base member 91, such as, a shaft. Conductive layer 93 is then formed on elastic layer 92, magnetic field forming layer 94 is thereafter formed on conductive layer 93, and insulation layer 95 is formed on magnetic field forming layer 94 to complete the construction of development member 9. In the same manner as described in previous examples, minute toner chains of toner 8 are formed on magnetic field forming layer 94, as illustrated in FIG. 9 resulting a thin and uniform toner layer on the surface of development roll member 9. Consequently, it becomes possible to obtain a high resolution image by applying a development bias voltage to conductive layer 93 to raise the development electrode effect. Also, by furnishing insulation layer 95 to be in a position to be in contact with toner 8, it becomes possible to control the charge polarity of and the amount of charge on toner 8 by choosing the insulative material triboelectrically. Also, employing a resin of superior friction resistance, such as, fluorine resin, in insulation layer 95 makes it possible to provide a protection layer for magnetic field forming layer 94 and makes it possible to maintain a stable development electrode effect. While the arrows in FIG. 9 indicate the direction of magnetization to be in the horizontal plane, magnetic field forming layer 94 may also be prepared as a vertically magnetized film.

By magnetizing magnetic field forming layer 94 in the horizontal direction so that the magnetic reverse pitch is under 100 μm, minute toner chains from magnetic toner 8 are formed on magnetic field forming layer 94 and a thin and stable toner layer is achieved. Also, by magnetizing magnetic field forming layer 94 in the vertical direction (not illustrated), it is possible to impart high density to the magnetic reverse pitch up to about the particle diameter of the toner, e.g., about 10 μm, it will be possible to uniformly form one or two thin layers of toner. The magnetic powder content rate of magnetic toner 8 will be lowered because a strong magnetic field is obtained on the surface magnetic field forming layer 94, making it possible to manufacture of toner with broader parameters while enhancing its adhering ability to development member 9.

While different examples of the development member layer construction have been described above, the construction of development member 9 in the development apparatus of this invention must have at least an elastic layer 11 and a magnetic field formin layer 12. Also, magnetic field forming layer 12 is conductive or an additional conductive layer, such as layers 53, 64, 84 or 93 is provided in combination with elastic layer 11 and magnetic field forming layer 12 then is not necessarily conductive. Also, base member 10 should provide support strength to the overall roller construction. An insulation layer, such as layers 74, 85 or 95, raise the chargeability of toner 8. Also, it is possible to increase durability and longevity of development member 9 by use of a protective layer, which may be a conductive layer of an insulative layer. Also, the deformability of development member 9 may be increased by forming a laminated member with one or more intermediate layers. It is also possible to merge the functions of the plural layers comprising development member 9 into a single layer and, if necessary, utilize intermediate layers between the layers comprising development member 9 to enhance the adhesion of adjacently formed layers of member 9. Also, it is possible to arrange floating electrodes in one or more layers to raise the development electrode effect.

The magnetized state of magnetic field forming layers 43, 45, 54, 63, 73, 83 or 94 may be any one of various magnetized states, such as, line magnetization, lattice magnetization or spiral magnetization. The magnetization need not be accomplished directly on development member 9 but rather may be suitably provided to a preformed magnetic field forming layer prior to its installation as a member in the development member construction.

Figure 10:
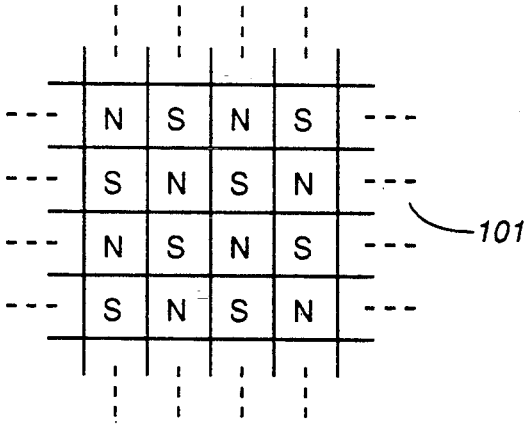
FIG. 10 is a general diagrammatic illustration of a magnetized state of the magnetic field forming layer in the development member of this invention.
Figure 11:
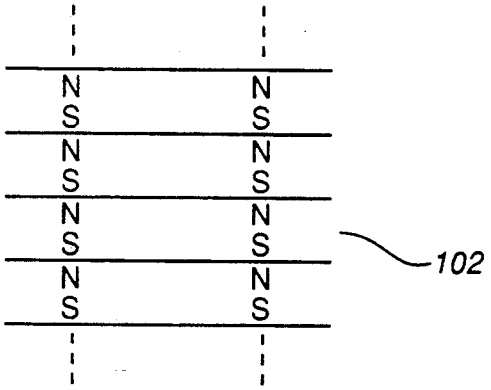
FIG. 11 is a general diagrammatic illustration of another magnetized state of the magnetic field forming layer in the development member of this invention.
Figure 12:
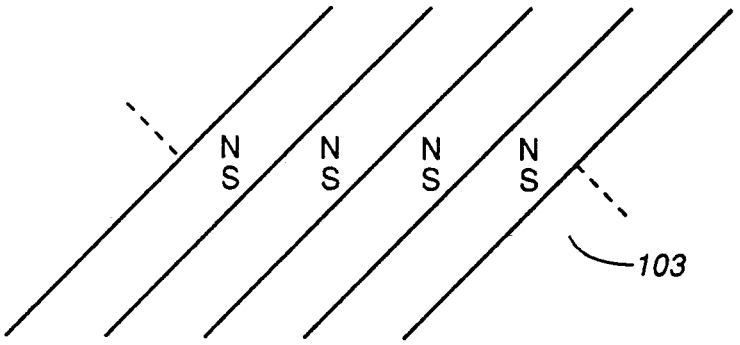
FIG. 12 is a general diagrammatic illustration of a further magnetized state of the magnetic field forming layer in the development member of this invention.

FIGS. 10–12 are diagrams illustrating the magnetic states of the magnetic field forming layers in the exemplified development members 9 of this invention shown in FIGS. 4–9.

FIG. 10 is a general diagram of a the magnetized state of magnetic field forming layer where the magnetic field 101 is magnetized in lattice form so that N-poles and S-poles appear alternate fashion. When magnetized in the horizontal direction so that the smallest magnetic reverse pitch is 50 μm to 100 μm, a magnetic flux density over 500 Gauss is achieved for magnetic field forming layer 101, providing for stable adhesion of toner to development member 9. Also, when magnetized in the vertical direction, it is possible to achieve magnetization with a narrower pitch and a higher magnetic flux density. Further, the magnetized state is not restricted to particular lattice forms, as it is possible to form a thin, stable layer of toner even in the case where magnetization is at an inclined lattice or magnetization pertains only to a portion of the lattice.

FIG. 11 is a general diagram of the magnetized state of the magnetic field forming layer in another example of the present invention where magnetic field 102 is magnetized so that N-poles and S-poles appear in alternate fashion in the axial direction or in the circumferential direction of development member 9. When magnetized in the horizontal direction so that the smallest magnetic reverse pitch is 50 μm to 100 μm, a magnetic flux density over 500 Gauss is achieved for the magnetic field forming layer providing for stable adhesion of toner to development member 9. Such a state of magnetization makes magnetization easy with comparatively fewer magnetizing poles. Also, when magnetized in the vertical direction, it is possible to obtain magnetization at a narrower pitch with a resulting higher magnetic flux density.

FIG. 12 is a general diagram of the magnetized state of the magnetic field forming layer in still another example of the present invention wherein magnetic field 103 is magnetized so that N-poles and S-poles appear in alternate fashion in a spiral form along development member 9. When magnetized in the horizontal direction so that the smallest magnetic reverse pitch is 50 μm a magnetic flux density over 500 Gauss is achieved in magnetic the field forming layer providing for stable adhesion of toner to development member 9. Such a state of magnetization makes magnetization easy with comparatively fewer magnetizing poles. Also, when magnetized in the vertical direction, it is possible to obtain magnetization at a narrower pitch with a resulting higher magnetic flux density.

In addition to the above described magnetization states, it is possible to provide methods of magnetizing at states where the magnetic reverse direction is nearly random or methods of magnetizing providing forms of magnetic poles that conform to the forms of circular magnetizing yokes. However, the present invention is one that is capable of forming stable thin films of toner 8 on development member 9 by magnetizing the magnetic field forming layer so that the smallest magnetic reverse interval is sufficiently small, particularly for examples under 100 μm, without dependency on any particular magnetization state.

Figure 13:
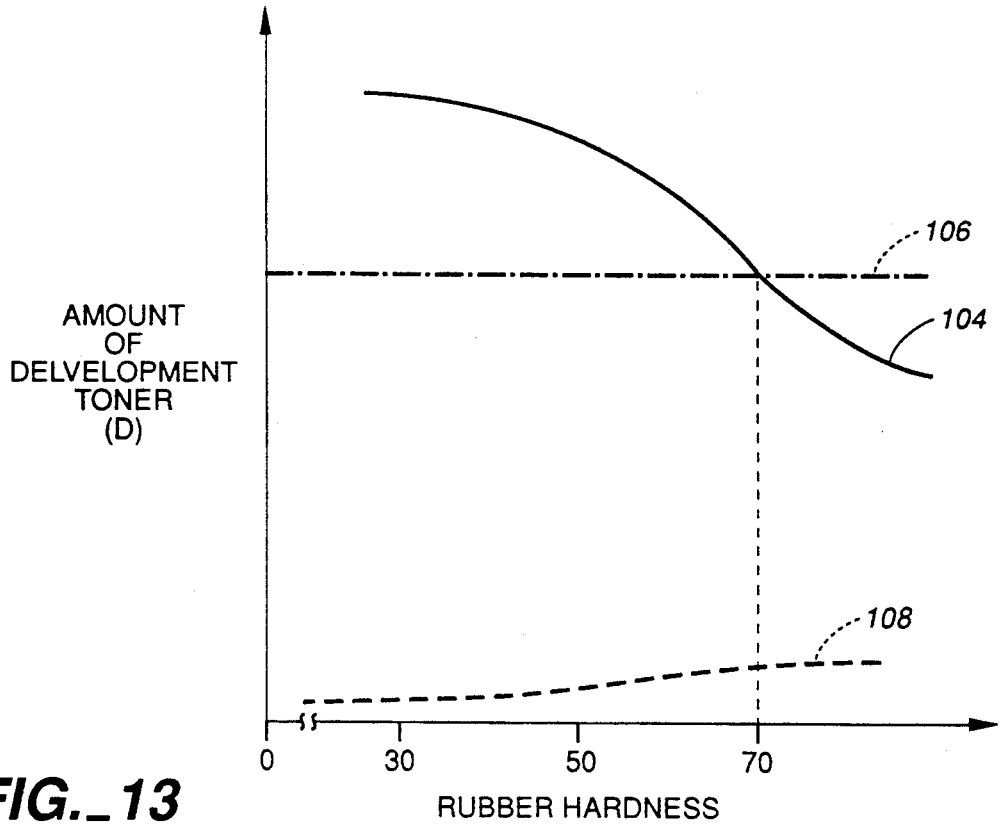
FIG. 13 is a graphic illustration of the variation in the amount of development toner when the rubber hardness of the elastic layer is varied.

FIG. 13 is a graphic illustration of variations in the amount of development toner when the rubber hardness (ASTM-D) of the development member elastic layer is varied relative to image formation apparatus disclosed in FIG. 2 utilizing a development member 9 comprising at least elastic layer 12 and magnetic layer 11. As shown in FIG. 13, the amount of development toner 104, representing the solid image portions of the developed image, decreases as the rubber hardness is increased. When rubber hardness reaches 70 degrees, the amount of development toner is below line 106 where an OD value of 1.4 is maintained. On the other hand, the amount of development toner 108, representing the amount of fogging toner in the non-image portions of the developed image, gradually increases as rubber hardness is increased. When the rubber hardness reaches about 70 degrees, toner development will result in the non-image portions to the extent that this type of contamination will be clearly recognizable to the human eye. Although the causes of this phenomenon are not clear, it is believed that at regions where the rubber hardness is low, the toner is sufficiently charged while, concurrently, a sufficient amount of toner is transported, and at regions where the rubber hardness is high, the toner is insufficiently charged and the retention force of the development member for efficient toner transport is insufficient. Consequently, by providing magnetic toner development with a development member 9 having at least a thin magnetic field forming layer and an elastic layer with rubber hardness below 70 degrees, it is possible to maintain sufficient image concentration and provide high resolution images without the occurrence of fogging in the non-image portions of the developed image.

Figure 14:
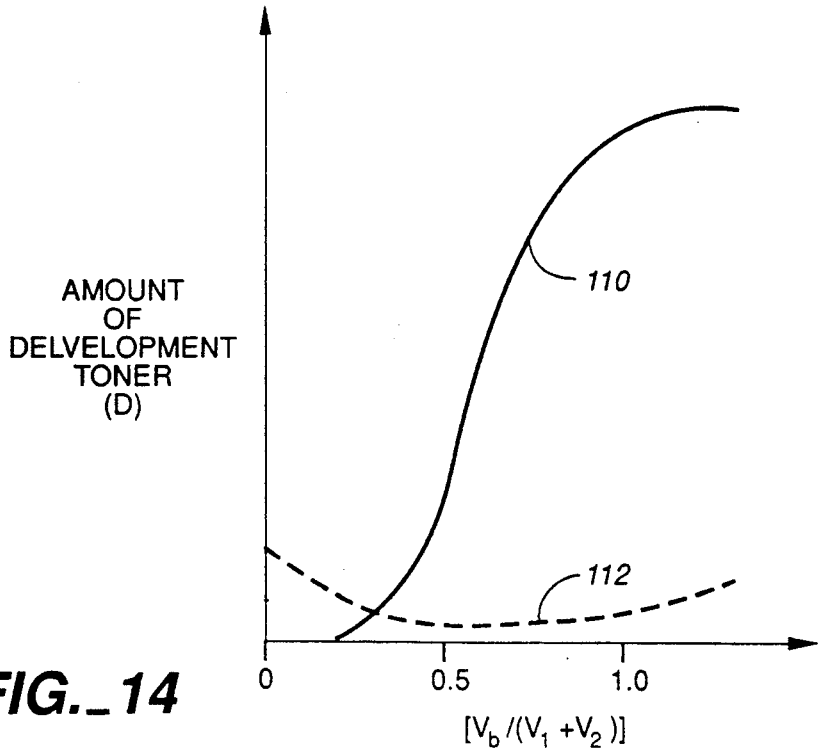
FIG. 14 is a graphic illustration of the variation in the amount of development toner relative to image portions nad non-image portions of a developed latent image where the development bias conditions are varied.

FIG. 14 is a graphic illustration of the amount of development toner in the image portions (110) and non-image portions (112) in a reversal development example where the development bias conditions are varied employing the development apparatus of the present invention utilizing the development member construction, such as, shown in FIG. 9. The horizontal axis is the voltage ratio relationship, $|V_b/(V_1+V_2)|$, where $V_b$ is bias development voltage, $V_2$ is the potential in the non-image portions and $V_1$ is the potential in the image portions. The vertical axis represents the amount of development toner formed on latent image carrier 1 in image portions 110 and non-image portions 112. Image portion development toner 110 increases with development bias in correspondence with the toner developing force and eventually becomes saturated. Non-image portion 112 has a smaller amount of development toner by magnetic retention force and development preventing Coulomb's force in the range of $1.0>|V_b/(V_1+V_2)|>0.5$, which is still a permissible amount for achieving high image resolution. Consequently, when the development apparatus of the present invention has $V_b$ set in the range where the development bias is $$\frac{|V_1+V_2|}{2} \leqq |V_b| \leqq |V_2|,$$

then, good quality images can be achieved without fogging.

Thus, by developing a latent electrostatic image with a development member containing at least an elastic layer and a magnetic field forming layer, as prescribed by this invention, while setting the development bias, $V_b$, to satisfy expression, $$\frac{|V_1+V_2|}{2} \leqq |V_b| \leqq |V_2|.$$

there will be the effect of being able to stabilize the amount of transported toner and form images in a stable manner with few nonuniformities in image density with little fogging. Further, by setting $V_b$ so as to continuously satisfy the expression, $$\frac{|V_1+V_2|}{2} \leqq |V_b| \leqq |V_2|,$$

it is possible to secure smaller variations in development properties caused by variations in $V_1$ and $V_2$ over time and, particularly, due to temperature variations over time resulting in development apparatus of significantly high reliability. In general, the range to form high quality images with appropriate setting of $V_b$ is approximately $400 \leqq |V_2| \leqq 1{,}000$ V and $0 \leqq |V_1| \leqq 200$.

Further, the roller type development apparatus is of a simple construction, of comparatively smaller size and lower manufacturing cost. In particular, because a minute pitch magnetic field is formed and the toner is uniformly retained on the development member with sufficient field strength, there will result a wider range of the development bias that prevents the occurrence of fogging in non-image portions due to toner contact with latent image carrier 1 in non-image regions. As a result, it is possible to provide development apparatus utilizing the features of this invention wherein the image forming apparatus is either of the contact development type or of the pressure contact development type. Also, when employing the pressure contact type of development, it is possible to draw out the development electrode effect to its maximum extent thereby forming images of the highest resolution and quality.

Figure 15:
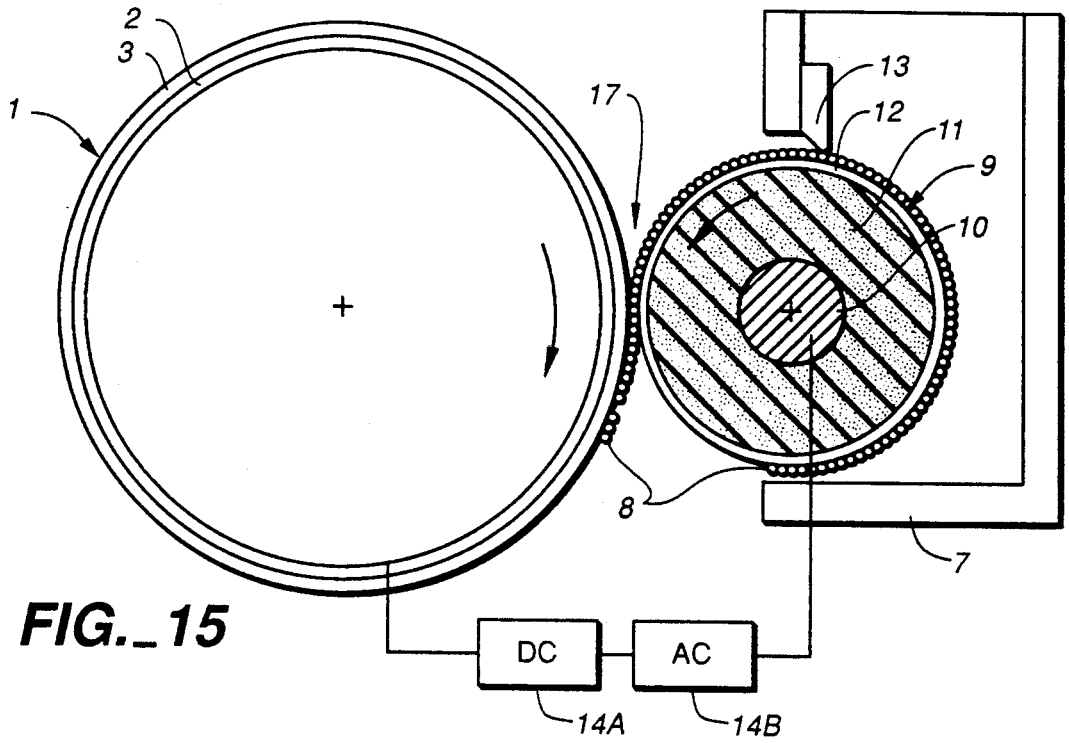
FIG. 15 is a side elevation of another embodiment of this invention.
Figure 16:
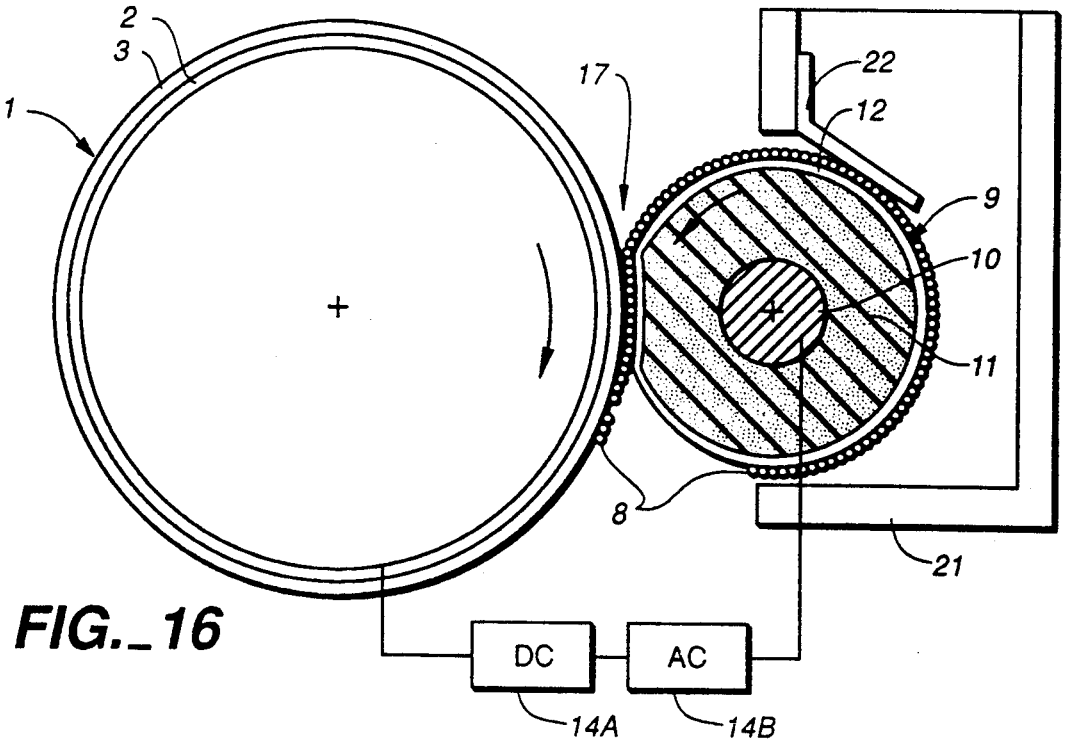
FIG. 16 is a side elevation of a further embodiment of this invention.

FIGS. 15 and 16 are respectively identical to FIGS. 1 and 2 and, therefore, like components are identified with the same numeral identification and, therefore, the description of FIGS. 1 and 2 is equally applicable to development apparatus of FIGS. 15 and 16, except that the development electrical field formed between development member 9 and latent image carrier 1 by the electrical potential contrast of latent image carrier 1 and DC development bias means 14 is accomplished by the combination of DC development bias means 14A and AC development bias means 14B to develop the electrostatic latent image on carrier 1.

Figure 17:
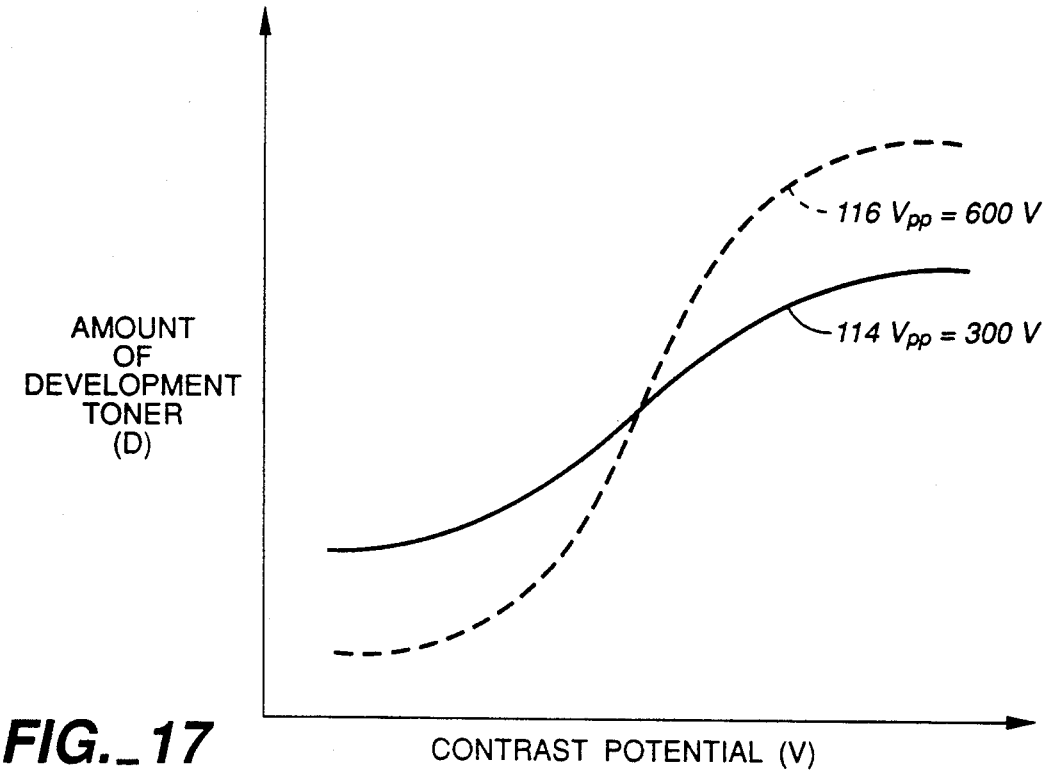
FIG. 17 is a graphic illustration of the variation in the amount of development toner relative to image portions and non-image portions of a developed latent image where the development bias conditions are varied in combination with an applied alternating field.

FIG. 17 is a graphic illustration showing the amount of development toner of a developed image on latent image carrier 1 wherein the development bias conditions are varied in conjunction with development apparatus of this invention, in particular, the apparatus shown in FIG. 2 and the development member 9 shown in FIG. 9. The horizontal axis is the contrast electrical potential, V, which is the difference between the electrical potential of the image portion and the electrical potential of development member 9 as fixed to the DC development bias. The vertical axis represents the amount of development toner, D, of the image formed on the latent image carrier. Thus, curves 114 and 116 in FIG. 17 are the resulting V-D properties of the developed image. FIG. 17 provides the parameters for the peak and bottom difference, $V_{pp}$, of the alternating current component of the development bias, i.e., $V_{pp}=300$ V (curve 114) and $V_{pp}=600$ V (curve 116), and shows a tendency for the slope of the V-D properties to accelerate as the value of $|V_{pp}|$ becomes larger. Consequently, it is preferred that $|V_{pp}| \geqq 300$ V for development apparatus suitable for application wherein modulation is required, such as, in the case of copiers. Also, the picture element unit density has two values, and in development apparatus, such as, employed in laser printers where it is best that these two values have wide density stability regions, it is preferred that these values be $100 \text{ V} \leqq |V_{pp}| \leqq 600$ V.

Figure 18:
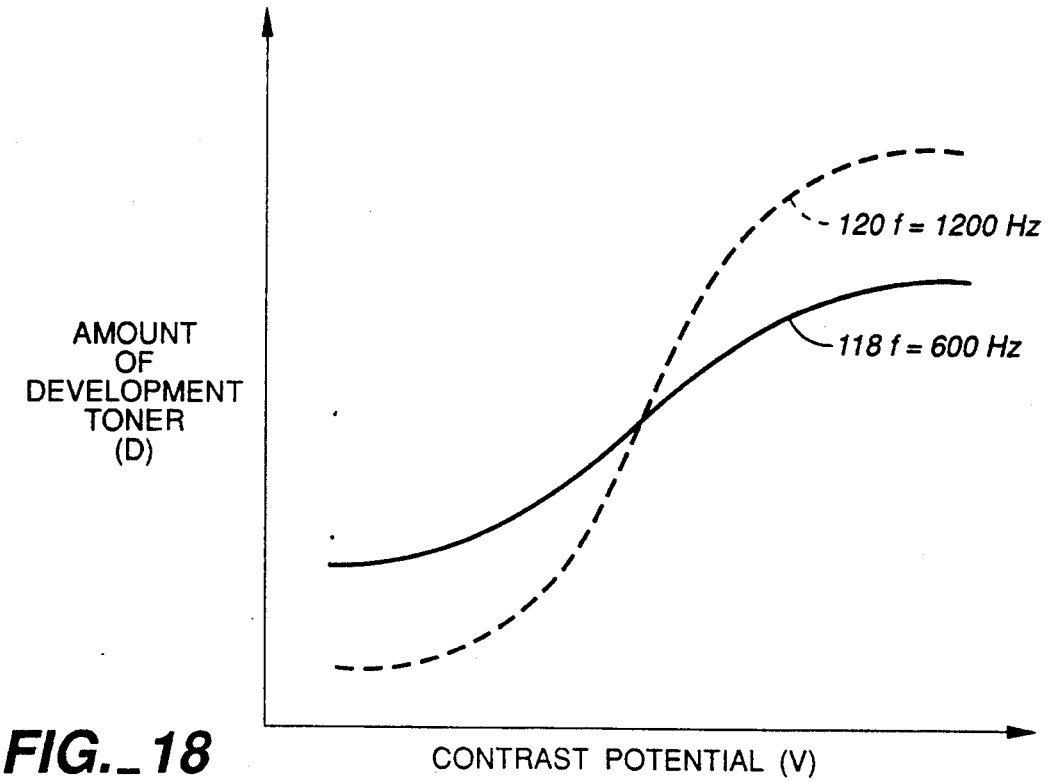
FIG. 18 is a graphic illustration of the variation in the amount of development toner relative to image portions and non-image portions of a developed latent image where the development bias conditions are varied in combination with an applied frequency.

FIG. 18 is a graphic illustration showing the amount of development toner in image portions of a developed image on latent image carrier 1 in another example wherein the development bias conditions are varied in conjunction with development apparatus of the type utilized relative to FIG. 17. The horizontal axis is the contrast electrical potential, V, which is the difference between the electrical potential of the image portion and the electrical potential of development member 9 as fixed to the DC development bias. The vertical axis represents the amount of development toner, D, of the image formed on latent image carrier. Thus, curves 118 and 120 in FIG. 18 are the resulting V-D properties of the developed image. FIG. 18 provides the parameters for frequency, f, i.e., f=600 Hz (curve 118) and f=1200 Hz (curve 120), of the alternating current component of the development bias and illustrates a tendency for the slope of V-D properties to accelerate as the value of f becomes larger. Consequently, it is preferred that $f \leqq 1{,}200$ Hz for development apparatus suitable for application wherein modulation is required, such as, in the case of copiers. Also, the picture element unit density has two values, and in development apparatus, such as, employed in laser printers where it is best that these two values have wide density stability regions, it is preferred that $f \geqq 600$ Hz.

Since contact development is accomplished by supplying a thin layer of toner 8 to the development region 17, the alternating electric field superimposing effect will be achieved, even in the case where the voltage of the AC component of the development bias is lower than that normally applied in prior art development apparatus. As a result, it is possible to provide a smaller, less expensive power source for the development bias.

Figure 19:
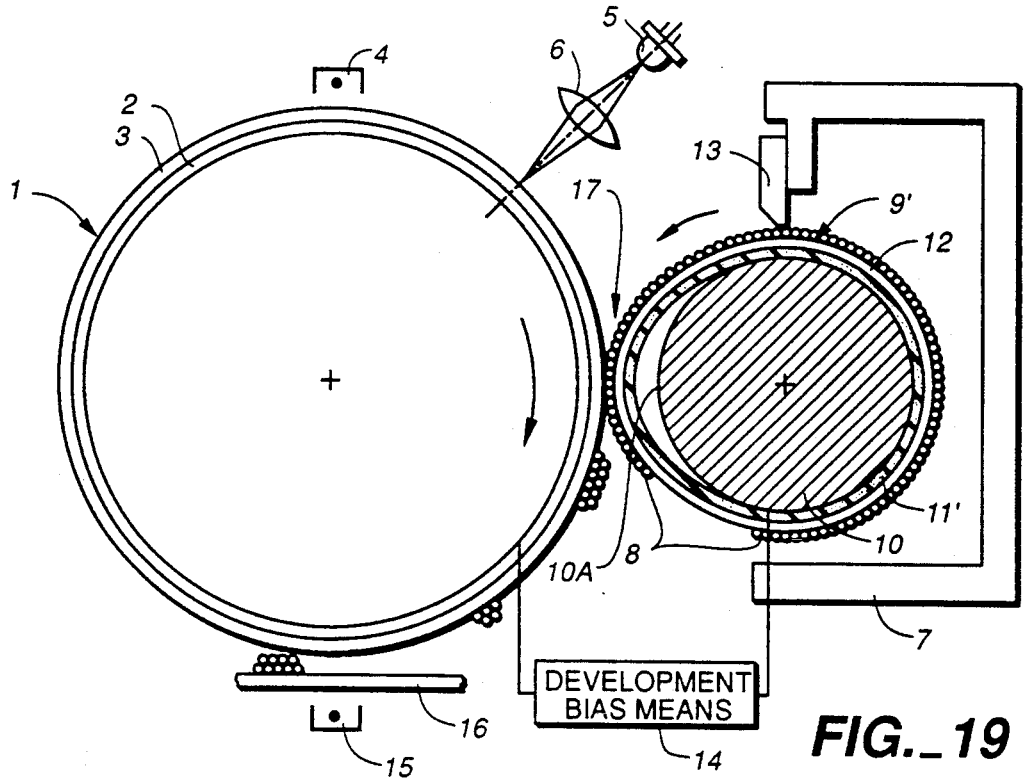
FIG. 19 is a side elevation of an image forming apparatus relative to another embodiment of the development apparatus of this invention.
Figure 19A:
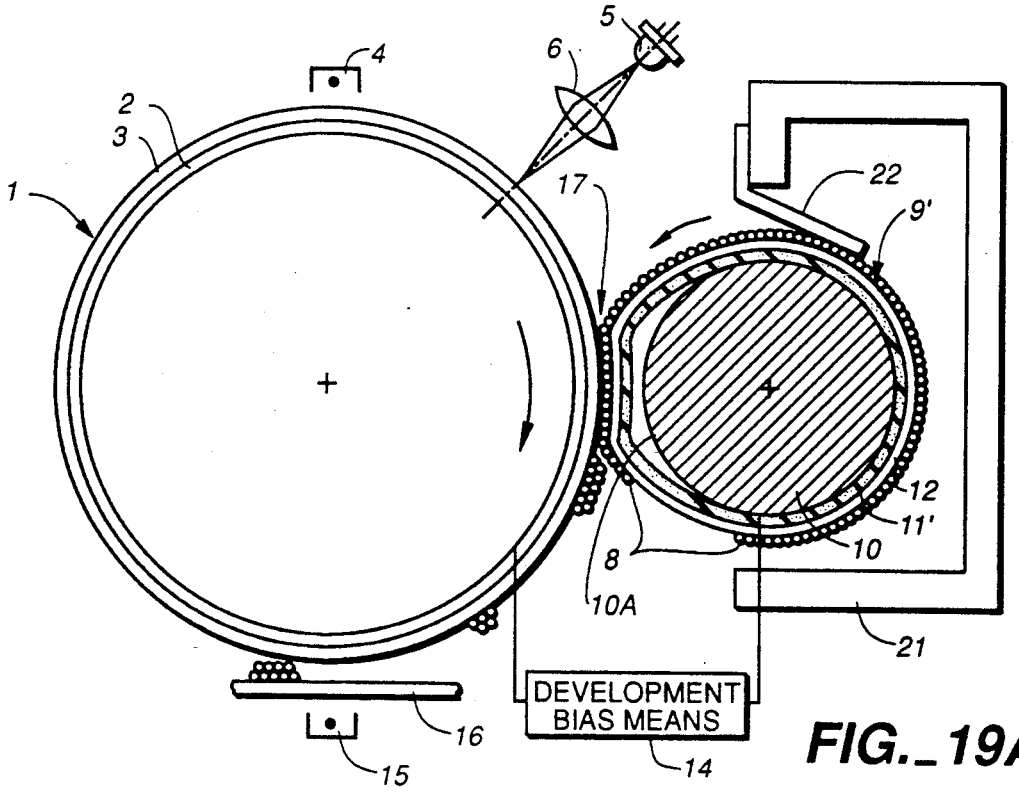
FIG. 19A is a side elevation of an image forming apparatus involving another embodiment of the development apparatus of this invention.

FIG. 19 is a side elevation of an image forming apparatus relative to another embodiment of the development member of this invention. Elements in FIG. 19 identical to corresponding elements in FIG. 1 carry the same numerical identification so that the description thereof is generally equally applicable to the image forming apparatus of FIG. 19. However, development apparatus 7 is provided with a different kind of development roller 9' that includes a tubular closed loop or endless membrane member 11' that has an ID that is larger than the OD of drive roller 10. A magnetic field forming layer 12 is formed on tubular membrane member 11'. Development roller 9' comprises drive roller 10 provided with a frictional surface 10A on its outer periphery and tubular membrane member 11' is mounted over roller 10 providing a surplus length relative to the outer periphery of drive roller 10, as depicted in FIG. 19. The larger membrane member 11' is held in engagement with drive roller 10 by means of arcuate shaped guide members (not shown) held against outer end portions of the endless membrane member, outside of its active toner transport surface, to maintain member 11' against a significant portion of the surface of drive roller 10 as depicted in FIGS. 19 and 19A. Magnetic toner 8 is retained in contact with the surface of development member 9' by the leakage magnetic flux at the outer periphery of magnetic field forming layer 12, and as development member 9' is rotated in a counterclockwise direction, the amount of toner 8 applied to the surface layer 12 is regulated by plate-shaped blade member 13, which is constructed of either non-magnetic or magnetic metal or resin. As a result, a thin layer of toner 8 is transported on the surface of development roller 9' to the development region 17. When toner 8 is transported to the development region 17 where latent image carrier 1 and development member 9' are in close proximity with one another, a development electrical field is formed by the electrical potential contrast of latent image carrier 1 and development bias means 14 and the toner is caused to adhere to latent image carrier 1 to develop the latent image thereon. Further, using transfer device 15, the image is transferred onto recording medium 16 and the transferred toner image is thereafter fixed to the recording medium. When the image forming apparatus shown in FIG. 19 was continually used to form 600 DPI line images and character images and solid images for 10,000 pages of recording medium, the 600 DPI line images were formed in a stable manner without line spread or expansion, high density solid images with OD values over 1.4 could be produced in a stable manner without tails or fogging at the image edges and with no fogging on the recording medium and even on latent image carrier 1. Also, the amount of waste toner is significantly reduced.

FIG. 19A is a side elevation of an image forming apparatus involving another embodiment of the development apparatus of this invention. Elements in FIG. 19A identical to corresponding elements in FIG. 19 carry the same numerical identification so that the description thereof is generally equally applicable to the image forming apparatus of FIG. 19A. Development apparatus 21 includes development roller 9' for the transport of magnetic toner 8 which is directly retained on the surface of development member 9' by the leakage magnetic flux produced around magnetic field forming layer 12. A thin layer of toner 8 is metered to a desired amount by elastic blade 22 of thin flexible sheet, which may be constructed of nonmagnetic or magnetic metal or resin. Development roller 9' in FIG. 19A, as compared to FIG. 19, is in pressure contact with latent image carrier 1 under a predetermined amount of pressure. When toner 8 on development member 9' is transported to development region 17 and the point of pressure contact against latent image carrier 1, toner 8 is charged in correspondence with the development electrical field from the electrical potential contrast of latent image carrier 1 and development bias means 14 and the toner is caused to adhere to latent image carrier 1 to develop the latent image thereon. Development roller 9' may be rotated at a peripheral velocity, $V_d$ and the pressure for pressure contact of development member 9' onto latent image carrier 1 is at a force of about 0.5 kgf to provide for a stable development state. Blade member 22 is not limited to an elastic blade but can be any known metering means employed with development apparatus, such as, for example, a steel blade.

When 600 DPI line latent images and character latent images and solid latent images were formed continuously for 10,000 pages employing the development apparatus of FIG. 19A, with the electrostatic latent image on latent image carrier 9 having an electrical potential $V_1 = -50$ V in the image portion and having an electrical potential $V_2 = -450$ V in the non-image portion and with development bias $V_b = -250$ V, and wherein the smallest magnetic reverse interval of the magnetic field forming layer 11 was about 80 μm, it was possible to form in a stable manner 600 DPI line images without line expansion. Also, the images contained no fogging or tails at image end portions, there was no excess toner in the facing image end portions, and high density solid images with OD values over 1.4 could be formed in a stable manner. Further, it was possible to greatly decrease the amount of waste toner left from the development process with no corresponding fogging on the recording medium since there was no fogging relative to latent image carrier 1.

Except for the loose and separate adaptation of membrane member 11' on drive roller 10 in the embodiments of development roller 9' in FIGS. 19 and 19A, the construction of development member 9' is similar to that shown for development apparatus 9 in FIGS. 1 and 2 but made different in that membrane member 11' is not fixed to drive roller 10. In FIGS. 19 and 19A, a frictional outer surface 10A of drive roller 10 is provided by means of employing a material, such a, natural rubber, silicone rubber, urethane rubber, butadiene rubber, chloroprene rubber and NBR around a metal or resin shaft. Roller 10 can also be a metal roller with a knurled or roughened surface. Rotational drive force is transmitted to membrane member by the frictional surface 10A by the force and pressure brought on membrane member 11' against the surface of drive roller 10. Also, membrane member 11' may be of a metal foil, such as, phosphor bronze, stainless steel or nickel, or resin membrane material, such as, nylon, polyamide or polyethylene terephthalate. The film thickness of membrane member 11' will vary depending on the material used for its construction but its thickness should be on the order of 10 μm to 500 μm in order to have sufficient pressure contact with latent image carrier 1. Further, as in the case of previous embodiments, magnetic field forming layer 12 can consist of known magnetic recording materials or magnetic materials, such as, magnetic materials containing at least one or more of Fe, Ni, Co, Cr or Mn, for example, $\gamma$-$Fe_2O_3$, Ba-Fe, Ni-Co, Co-Cr or Mn-Al. The membrane thickness should be thin, i.e., below 100 μm, preferably about 10 μm, so that nonuniform densities can be reduced by forming a uniform thin layer of toner 8 with the smallest magnetic reverse pitch under 500 μm, preferably under 100 μm. As a result, it will be possible to suppress variations in the amount of toner 8 transported on development member 9' because of the formed magnetic brush while simultaneously providing a uniformly thin layer of toner which results in a reduction in nonuniform densities. In particular, because the velocity ratio between peripheral velocity, $V_d$, of development member 9' and peripheral velocity, $V_p$, of latent image carrier 1 is $$1 \leqq V_d/V_p,$$

a sufficient amount of toner is provided to latent image carrier 1 to form high density images. Further, with $$V_d/V_p \leqq 5,$$

it will be possible to eliminate disarrays in images caused by the relative velocities of latent image carrier 1 and development member 9' and reduce the occurrence of tails caused by adhesion of toner on the end portions of characters and fine line portions of the developed image. Also, toner retention on development member 9' by the magnetic force, even in the case where considerably large amounts of toner are supplied to latent image carrier 1, forming images of high area gradations with little fogging occurring on non-image portions.

In regard to the smallest magnetic reverse interval of development member 9', a thin layer of toner 8 is formed uniformly applied onto the surface of development member 9' at an interval under 500 μm, e.g., at about 80 μm, in order to produce clear narrow lines and isolated dots in the developed image, even when the smallest dot pitch in optical exposure of the latent image is below 100 μm. With such low intervals, it is possible to increase the reproducibility of isolated dots and the reproducibility of fine lines caused by transported nonuniformities of toner 8 so that nonuniform densities are almost indiscernible with the human eye. However, when the smallest magnetic reverse interval is over 500 μm, for example, 1,000 μm, nonuniform densities in the solid image portions will be clearly discernable by the human eye. It will be difficult to reproduce image tones because the number of area gradations in a design matrix of 4 vertical dots and 4 horizontal dots will only be eight tones or less.

As indicated in connection with previous embodiments, toner employed in this invention may be known single component magnetic toners either of the resin type or of the wax type. The composition of the developer, as is well known, will be made by adding magnetic powders or colorants or external additives or other additives to resin, and it may be accomplished, for example, by the pulverization method or the polymerization method.

Further, as in the case of the FIGS. 1 and 2 embodiments, the embodiments shown in FIG. 19 and FIG. 19A are not restricted to the particular constructions shown, such as, for example, the rotational directions of the respective rotatable members shown may be reversed, carrier 1 may be in the form of a belt rather than a drum, and the development method employed may be either of the ordinary development type or the reversal development type.

FIGS. 20–25 illustrate different constructions for development member 9' comprising this invention.

Figure 20A:
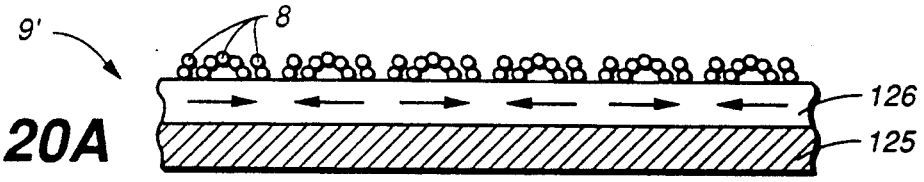
FIG. 20A is a cross sectional view showing the layer construction of the development member relative one example of the present invention.
Figure 20B:
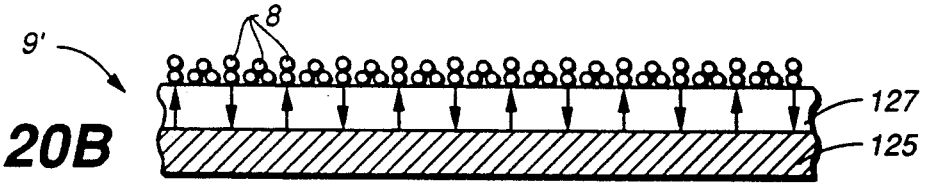
FIG. 20B is a cross sectional view showing the layer construction of development member relative to another example of the present invention.

FIG. 20A is a cross sectional view showing the layer construction of a membrane member/magnetic field forming layer of development member member 9' in one example of the present invention. Magnetic field forming layer 126 is formed on membrane member 125 and magnetic field forming layer 126 is magnetized in the horizontal direction, i.e., in the plane of the film, with a magnetic reverse pitch under 100 μm thereby permitting the formation of minute toner chains of toner 8 on magnetic field forming layer 126 resulting in a thin and stable toner layer, as illustrated in FIG. 20A. Also, by forming membrane member 125 with resin containing a conductive material, such as, conductive metal foil or carbon black dispersed in elastic resin, it is possible to obtain high resolution images by applying a development bias voltage on membrane member 125 to also enhance the development electrode effect. Also, as illustrated in FIG. 20B, by magnetizing magnetic field forming layer 127 in the vertical direction, i.e., transverse to the plane of layer 127, it is possible to make the magnetic reverse pitch of high density up to approximately the particle diameter of toner 8, for example, about 10 μm. Also, it is possible to achieve a single thin and uniform layer of toner 8 because a strong magnetic field is obtained at the surface of the magnetic field forming layer 127. Thus, it is, therefore, possible to decrease the magnetic powder content rate of toner 8 and increase the flexibility of toner manufacturing specifications and ease of its manufacture. In the example of development member 9' in FIG. 20B, by forming soft magnetic material on the back surface of magnetic field forming layer 127 to form a magnetic path, it becomes possible to achieve a stronger magnetic field on the surface of magnetic field forming layer 127.

Figure 21:
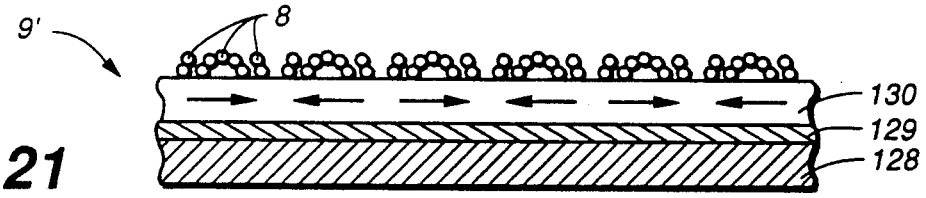
FIG. 21 is a sectional view of another example of the development roll member that may be employed with this invention.

FIG. 21 is a sectional view of another example of the development roll member 9' that may be employed with this invention. Conductive layer 129 is formed on membrane member 128. Magnetic field forming layer 130 is formed on conductive layer 129, which is magnetized in the horizontal direction with a magnetic reverse pitch is under 100 μm. As a series of result, a minute toner chains of toner 8 are formed on magnetic field forming layer 130, as illustrated in FIG. 21, resulting in a thin and uniform toner layer on the surface of development roll member 9'. Consequently, it is possible to obtain a high resolution image by applying a development bias voltage on conductive layer 129 to enhance the development electrode effect. The material employed for membrane element 128 may be a material containing a conductive metal, such as, Al or Ni, and, in addition, may be conductive material, such as, carbon black. Also, it is possible to form conductive layer 129 on membrane member 128 by means of an adhesive process or it may be formed by coating or plating the material onto membrane member 128. Lastly, while the arrows in FIG. 21 indicate the direction of magnetization to be in a horizontal plane, magnetic field forming layer 130 may also be prepared as a vertically magnetized film.

Figure 22:
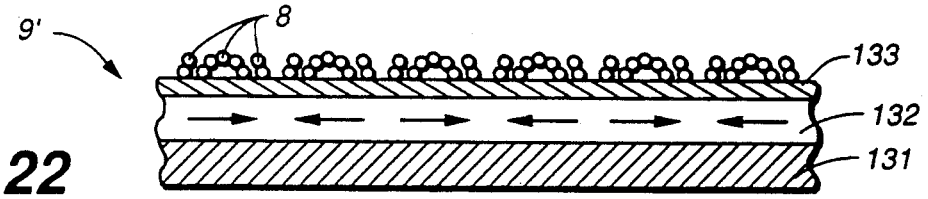
FIG. 22 is a sectional view of another example of the development member that may be employed with this invention.

FIG. 22 is a sectional view of another example of the development roll member 9' that may be employed with this invention. Magnetic field forming layer 132 is formed on membrane member 131 and conductive layer 133 is formed on magnetic field forming layer 132. By magnetizing magnetic field forming layer 132 in the horizontal direction with a fine magnetic reverse pitch under 100 μm, a minute toner chain formed from toner 8 can be created on conductive layer 133 resulting in a thin and uniform layer of toner for transport to latent image carrier 1. As a result, it is possible to achieve a high resolution image by the application of a development bias voltage on conductive layer 133 to increase the development electrode effect. When conductive layer 133 is formed of a metal film that includes, for example, Ni or Cr, layer 133 will also function as a protective film for magnetic field forming layer 132 resulting in longer life for development member 9'. Further, as in previous examples, layer 132 may be magnetically oriented vertically relative to the plane of layer 132.

A minute toner chain formed from toner 8, for example, on conductive layer 133 in the FIG. 22, by the magnetic field produced by magnetic field forming layer 132, will be produced on the surface of layer 133 in a thin and stable layer. By means of this layer construction, it is possible to apply a development bias voltage to conductive layer 133 to raise the development electrode effect and obtain high resolution images. Further, when such a layer construction is adopted, it will be possible to form high density solid images of OD values over 1.4 having high resolution line images of 600 DPI over an entire range of $1 \leqq V_d/V_p \leqq 5$.

Thus, in a development member 9' having at least a thin tubular membrane member with the membrane member comprising at least a magnetic field forming layer, by making the ratio value $V_d/V_p$, i.e., the ratio of the peripheral velocity, $V_d$, of membrane member 9' and peripheral velocity, $V_p$, of latent image carrier 1, greater than 1 but less than 5, while also making the smallest magnetic reverse interval of the magnetic field forming layer below 500 μm, it is possible to form high picture quality images at high resolutions in a stable manner with superior reproducibility of fine lines and isolated image dots without image density nonuniformities. Thus, the image forming apparatus of this invention is well suitable for high density development of single component magnetic toner with indiscernible tails, fogging or density nonuniformities.

Figure 23:
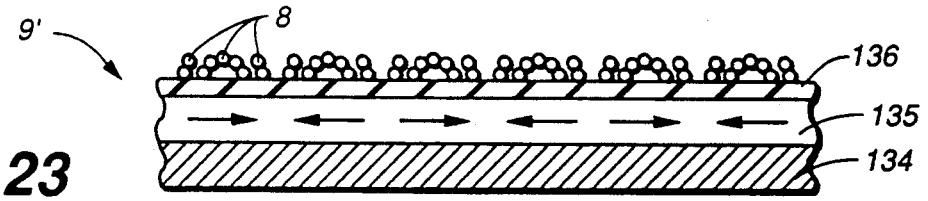
FIG. 23 is a sectional view of another example of the development member that may be employed with this invention.

FIG. 23 is a sectional view of another example of the development roll member 9' that may be employed with this invention. Magnetic field forming layer 135 is formed on membrane member 134 and insulating layer 136 is formed on magnetic field forming layer 135. By magnetizing magnetic field forming layer 135 in the horizontal direction so that the magnetic reverse pitch is under 100 μm, a minute toner chain formed from toner 8 is created on insulating layer 136 resulting in the formation of a thin and uniform layer of toner for delivery to development region 17. By forming insulating layer 136 on the outer surface of development member 9', it becomes possible to control the charge polarity of and the amount of charge on toner 8 by choosing the insulative material triboelectrically. Also, employing resin of superior friction resistance, such as, fluorine resin, makes it possible to provide a protection layer on magnetic field forming layer 135. While the arrows in FIG. 23 indicate the direction of magnetization to be in the horizontal plane, magnetic field forming layer 135 may also be prepared as a vertically magnetized film.

Figure 24:
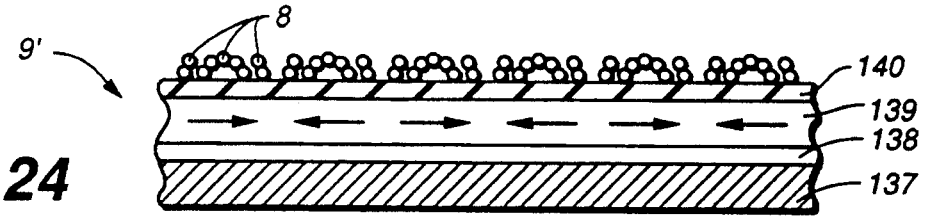
FIG. 24 is a sectional view of another example of the development member that may be employed with this invention.

FIG. 24 is a sectional view of another example of the development roll member 9' that may be employed with this invention. Conductive layer 138 is formed on membrane member 137, magnetic field forming layer 139 is then formed on conductive layer 138 and insulating layer 140 is formed on magnetic field forming layer 139. Minute toner chains are formed from toner 8 is created on insulating layer 140 resulting in a thin and uniform layer of toner 8, as depicted in FIG. 24. In this example, not only does conductive layer 138 provide an enhanced development electrode effect, but also the surface of membrane member 137 is made smooth in order to make the formation of magnetic field forming layer 139 easier. By forming insulating layer 140 on the outer surface of development member 9', it becomes possible to control the charge polarity of toner 8 and by employing a resin having superior friction resistance, such as, fluorine resin, layer 140 also functions as a protection layer for magnetic field forming layer 139. Further, as in previous examples, layer 139 may be magnetically oriented vertically relative to the plane of the film.

Figure 25:
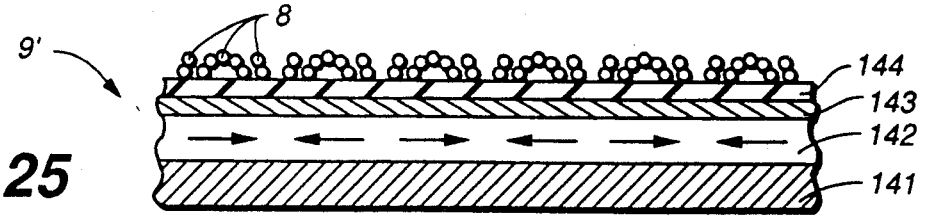
FIG. 25 is a sectional view of another example of the development member that may be employed with this invention.

FIG. 25 is a sectional view of another example of the development roll member 9' that may be employed with this invention. Magnetic field forming layer 142 is formed on membrane member 141, conductive layer 143 is then formed on magnetic field forming layer 142 and insulating layer 144 is formed on conductive layer 143. By magnetizing magnetic field forming layer 142 in the horizontal direction so that the magnetic reverse pitch is under 100 μm, minute toner chains are formed from available toner 8 in apparatus 7 resulting in a thin and uniform layer on insulating layer 144. In this example, high resolution image quality is achieved by forming conductive layer 143 in a region of development member 9' to be in closer proximity to latent image carrier 1 at the development region 17 functioning as a development electrode as well as controlling the charge polarity and charge amount of toner 8 by choosing the insulative material triboelectrically. Also, by forming insulating layer 144 on the outer surface of development member 9', it becomes possible to control the charge polarity of toner 8 and by employing a resin having superior friction resistance, such as, fluorine resin, layer 144 also functions as a protection layer for conductive layer 143 and provides for maintenance of a stable development electrode effect. Further, as in previous examples, layer 142 may be magnetically oriented vertically relative to the plane of the film.

The previous discussion relative to FIGS. 10–12 illustrating the magnetic states of the magnetic field forming layers for the exemplified development members 9 disclosed and discussed in connection with FIGS. 4–9 are equally applicable to the magnetic field forming layers for the exemplified development members 9' of FIGS. 20–25 and will, therefore, this discussion is not repeated here.

As previously mentioned, development member 9' in the development apparatus of this invention contains at least an elastic layer and a magnetic field forming layer and will comprise, as essential elements for its construction, membrane member 11' including magnetic field forming layer 12 and drive roller 10 for driving membrane member 11'. However, an insulating layer 136, 140 or 144 may be added to increase the chargeability of toner 8 or a conductive layer 129, 133, 138 and 143 may be included in the construction to provide an enhanced development electrode effect. In addition, the durability of the magnetic forming layer and the conductive layer can be enhanced by the use of a protective layer. Still further, the formability and adhesion of adjacent layers can be enhanced by providing one or more intermediate layers. Also, the functionality provided by the several layers of the development member 9' can be combined into a single layer, membrane belt to be rotatably driven by drive roll 10. Also, the magnetic state of magnetic field forming layers 126, 127, 130, 132, 135, 139 and 142 can be provided with different magnetic states, such as, line magnetization or lattice magnetization or spiral magnetization, such as described relative to FIGS. 10–12. The magnetic state need not be directly applied to the magnetic development member but a magnetic field forming layer may be initially prepared and then magnetically oriented and thereafter secured, such as by adhesive, to the structure of the development roll member 9'.

Figure 26:
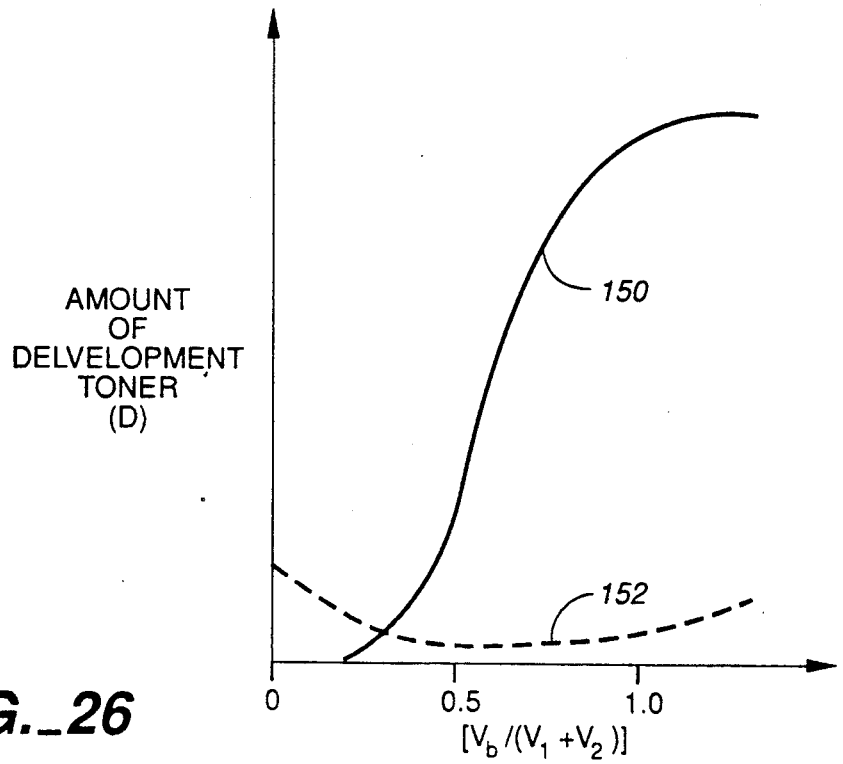
FIG. 26 is a graphic illustration of the variation in the amount of development toner relative to image portions and non-image portions of a developed latent image where the development bias conditions are varied.

FIG. 26 is a graphic illustration of the amount of development toner in image portions (150) and non-image portions (152) in a reversal development example where the development bias conditions were varied, employing the development apparatus of the present invention utilizing the development membrane construction, such as, shown in FIG. 24. The horizontal axis is the voltage ratio relationship, $|V_b/(V_1+V_2)|$, where $V_b$ is the bias development voltage, $V_2$ is the potential in the non-image portions and $V_1$ is the potential in the image portions. The vertical axis represents the amount of development toner formed on latent image carrier 1 in image portions 150 and non-image portions 152. Image portion development toner 150 increases with development bias in correspondence with the toner developing force and is eventually saturated. Non-image portion 152 has a small amount of development toner by magnetic retention force and development preventing Coulomb's force in the range of $1.0>|V_b/(V_1+V_2)|>0.5$, which is still a permissible amount for achieving high image resolution. Consequently, when the development apparatus of the present invention has $V_b$ set in the range where the development bias is $$\frac{|V_1+V_2|}{2} \leqq |V_b| \leqq |V_2|,$$

then, good images will be achieved without fogging.

Thus, within development apparatus of the type shown in FIG. 19A wherein development is accomplished by contacting latent image carrier 1 with toner 8 transported by development member 9' comprising drive roller 10 and tubular membrane member 11' on which is formed magnetic field forming layer 12, toner developing force in image portions and the retention force in non-image portions may be optimized by setting the development bias, $V_b$, to satisfy the expression, $$\frac{|V_1+V_2|}{2} \leqq |V_b| \leqq |V_2|.$$

As a result, there is little nonuniformity in developed image density and little, if any, fogging. Further, by setting $V_b$ so as to constantly satisfy expression, $$\frac{|V_1+V_2|}{2} \leqq |V_b| \leqq |V_2|,$$

it will be possible to have smaller variations in development properties caused by variations in $V_1$ and $V_2$ over time and particularly by variations in temperature, thereby providing development apparatus of high reliability. In general, the range to form high quality images with appropriate setting of $V_b$ is approximately $400 \leqq V_2 \leqq 1{,}000$ V and $0 \leqq V_1 \leqq 200$.

Further, by employing the membrane member type development apparatus of this invention, it becomes possible to provide a development apparatus that reduces toner waste and provides for inexpensive operating costs, simpler in construction, of smaller size and capable of forming stable images of high picture quality at high resolution. Also, it becomes possible to offer development apparatus that can be applied either in the contact development mode (FIG. 19) or the pressure contact development mode (FIG. 19A), and, in particular, when employing the contact development mode, the development electrode effect will be enhanced to the greatest extent forming toned images of the highest resolutions.

Reference is now made to the image forming apparatus in the embodiment shown in FIG. 19A employing a development member member 9' of the construction type shown in FIG. 22. The surface roughness of conductive layer 133, which is the surface in contact with toner 8 on development member 9', is made sufficiently smaller than the smallest magnetic reverse interval, which is about 80 μm, so that a thin layer of toner 8 will not be rendered nonuniform because of the large surface roughness of layer 133 of development member 9'. The surface roughness is below the bulk mean particle diameter of toner 8, e.g., about 10 μm, and, preferably, on the order of ½ the bulk mean particle diameter so as to prevent toner 8 from adhering mechanically to conductive layer 133. The contact area between toner 8 and conductive layer 133 is sufficiently maintained so as to increase the frictional or triboelectrical chargeability of toner 8 and thereby retain toner on its surface in a more stable manner. It is also possible to apply development bias voltage to conductive layer 133 in order to raise the development electrode effect to achieve a higher resolution image. Further, as previously indicated, when conductive layer 133 is formed from a metal film containing, for example, Ni or Cr, conductive layer 133 functions as a protective film for magnetic field forming layer 132 providing extended longevity to the development member. Thus, it is possible to form a stable thin layer of toner on the development member by magnetizing the magentic field forming layer in a manner that the smallest magnetic reverse interval is sufficiently small, preferably below 100 μm.

The foregoing surface roughness aspect is not limited to a conductive surface such as conductive layer 133 but is also applicable to top layers on member 9' comprising, for example, magnetic field forming layer 130 in FIG. 21 or insulating layer 137 in FIG. 23.

Figure 27:
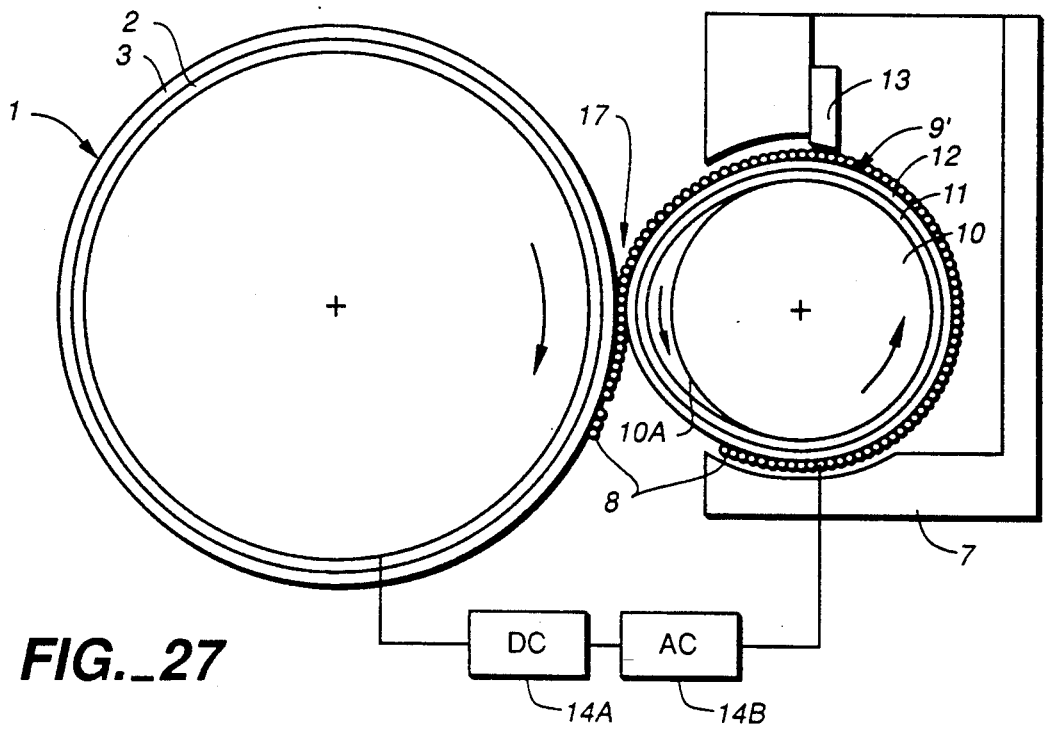
FIG. 27 is a side elevation of another embodiment of this invention.
Figure 28:
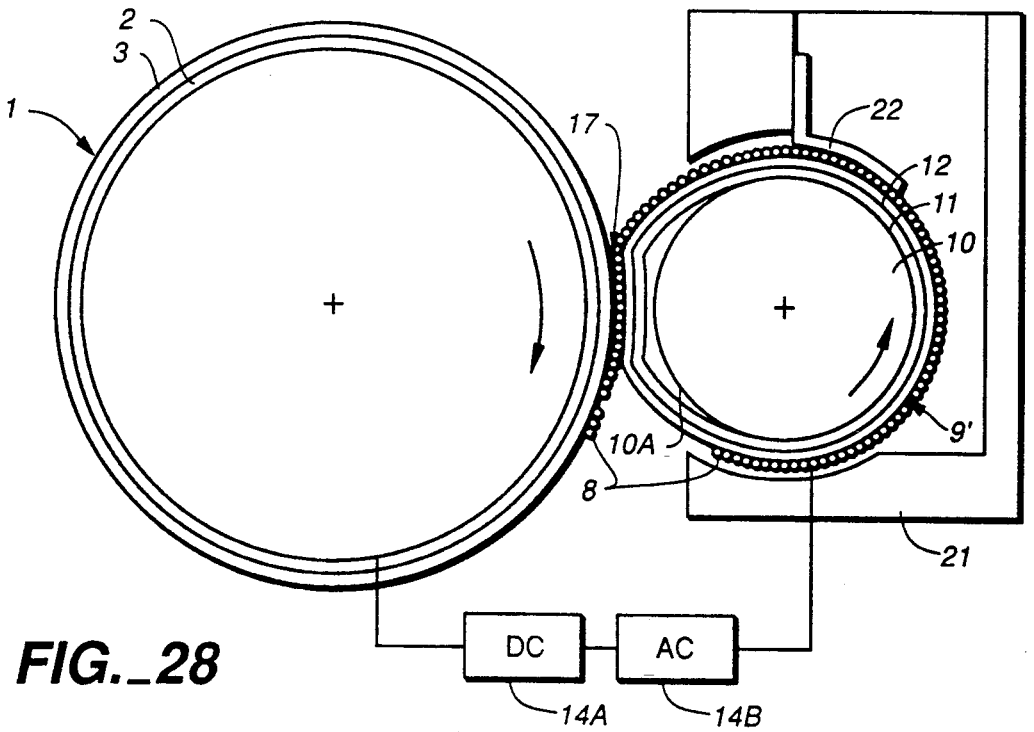
FIG. 28 is a side elevation of a further embodiment of this invention.

FIGS. 27 and 28 are respectively identical to FIGS. 19 and 19A and, therefore, like components are identified with the same numeral identification and, therefore, the description of FIGS. 19 and 19A is equally applicable to development apparatus of FIGS. 27 and 28, except that drive roller 10 is illustrate the development electrical field formed between development member 9' and latent image carrier 1 by the electrical potential contrast of latent image carrier 1 and DC development bias means 14 is accomplished by the combination of DC development bias means 14A and AC development bias means 14B to develop the electrostatic latent image on carrier 1.

Figure 29:
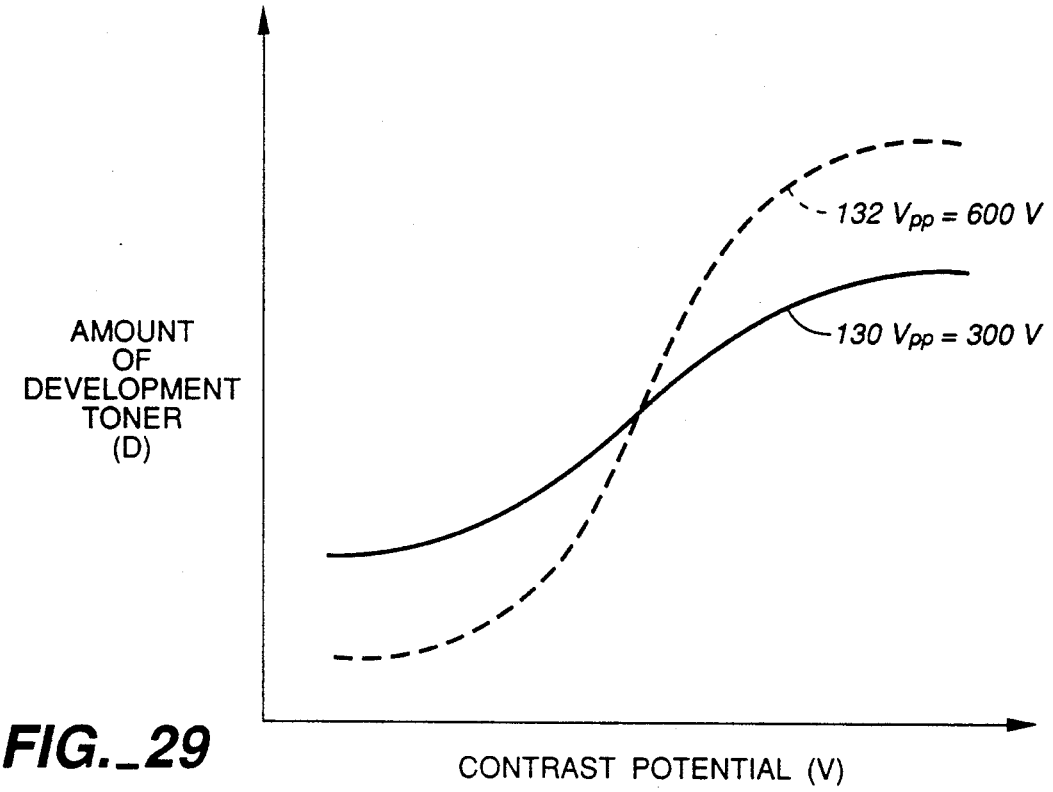
FIG. 29 is a graphic illustration of the variation in the amount of development toner relative to image portions and non-image portions of a developed latent image where the development bias conditions are varied in combination with an applied alternating filed.

FIG. 29 is a graphic illustration showing the amount of development toner in image portions of a developed image on carrier 1 wherein the development bias conditions were varied in conjunction with development apparatus of this invention, in particular, the apparatus shown in FIG. 19A and the development member 9' of FIG. 24. The horizontal axis is the contrast electrical potential, V, which is the difference between the electrical potential of the image portion and the electrical potential of development member 9' as fixed to the DC development bias. The vertical axis represents the amount of development toner, D, of the image formed on the latent image carrier. Thus, curves 130 and 132 in FIG. 29 are the resulting V-D properties of the developed image. FIG. 29 provides the parameters of the peak and bottom difference, $V_{pp}$, of the alternating current component of the development bias, i.e., $V_{pp}=300$ V (curve 130) and $V_{pp}=600$ V (curve 132), and shows the tendency for the slope of V-D properties to accelerate as the value of $|V_{pp}|$ becomes larger. Consequently, it is preferred that $|V_{pp}| \geqq 300$ V for development apparatus suitable for application wherein modulation is required, such as, in the case of copiers. Also, the picture element unit density has two values, and in development apparatus, such as, employed in laser printers where it is best that these two values have wide density stability regions, it is preferred that the values be $100 \text{ V} \leqq |V_{pp}| \leqq 600$ V.

Figure 30:
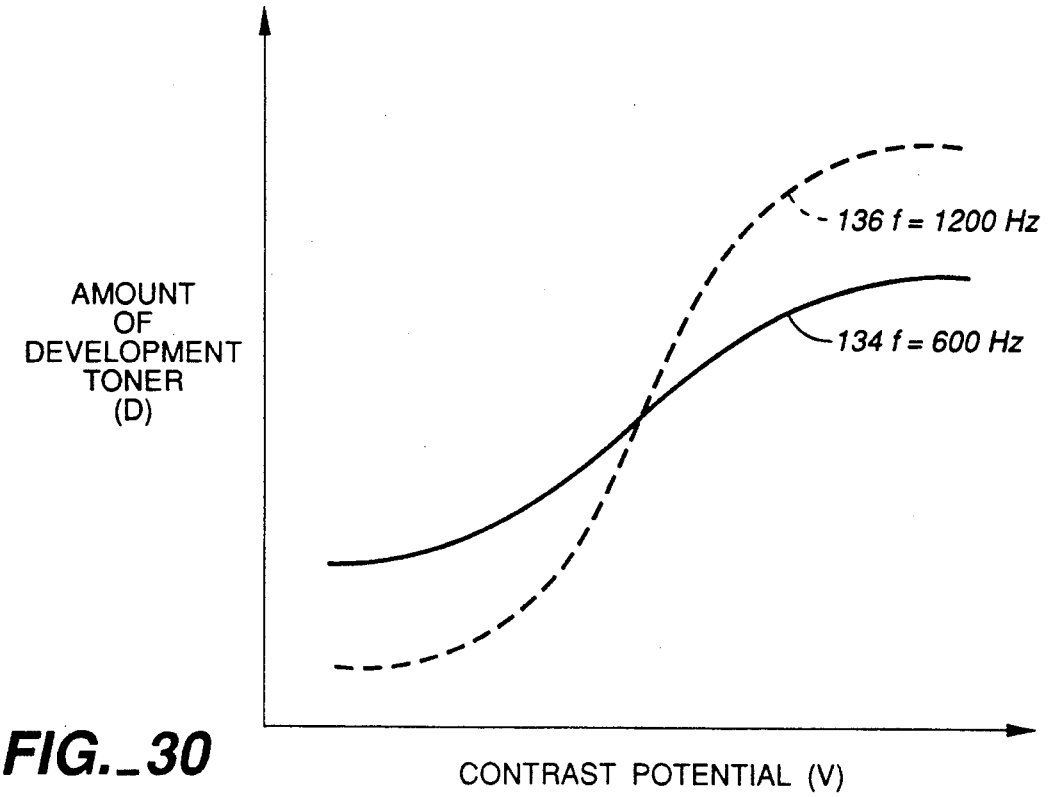
FIG. 30 is a graphic illustration of the variation in the amount of development toner relative to image portions and non-image portions of a developed latent image where the development bias conditions are varied in combination with an applied frequency.

FIG. 30 is a graphic illustration showing the amount of development toner in image portions of a developed image on latent image carrier 1 in another example wherein the development bias conditions are varied in conjunction with development apparatus shown in FIG. 19A in combination with the development member 9' of FIG. 24. The horizontal axis is the contrast electrical potential, V, which is the difference between the electrical potential of the image portion and the electrical potential of development member 9' as fixed to the DC development bias. The vertical axis represents the amount of development toner, D, of the image formed on the latent image carrier. Thus, curves 134 and 136 in FIG. 30 are the resulting V-D properties of the developed image. FIG. 30 provides the parameters of frequency, f, i.e., f=600 Hz (curve 134) and f=1200 Hz (curve 136) of the alternating current component of the development bias and illustrates the tendency for the slope of V-D properties to accelerate as the value of f becomes larger. Consequently, it is preferred that $f \leqq 1{,}200$ Hz for development apparatus suitable for application wherein modulation is required, such as, in the case of copiers. Also, the picture element unit density has two values, and in development apparatus, such as, employed in laser printers where it is best that these two values have wide density stability regions, it is preferred that $f \geqq 600$ Hz.

As indicated previously, since contact development will be done by supplying toner 8 to development region 17, the alternating electric field superimposing effect will be achieved, even in the case where the voltage of the AC component of the development bias is lower than that normally applied in prior art development apparatus. As a result, it is possible to provide a smaller, less expensive power source for the development bias.

In summary, the development member utilized in the development apparatus of this invention comprises at least an elastic layer and a magnetic field forming layer with development of an image accomplished with the application of a DC electrical field or a combination DC and AC electrical field at the development region formed between the development member and the latent image carrier. The resulting development apparatus is simple in construction, smaller in size and cost effective compared to previous such apparatus while providing, in a stable manner, continuous quality images having high resolution without fogging. Also, toner is supplied to the development region in a stable manner with a uniform magnetic force so that either contact development or pressure contact development can be utilized. In particular, when using pressure contact development, the development electrode effect can be produced to its greatest potential contrast to form developed images of the highest resolutions. Lastly, by including a conductive layer or an insulation layer, or both in the construction of the development member, the durability and the development electrode effect of the development member are enhanced.

Consequently, the development apparatus of the present invention is one that has the superior effect of being capable of offering development apparatus providing high resolution images with few image defects, such as, fogging and image tails, employing the principal of single component magnetic toner development.

While the invention has been described in conjunction with several specific embodiments, it is evident to those skilled in the art that many further alternatives, modifications and variations will be apparent in light of the forgoing description. For example, this invention has been described in conjunction with single component magnetic toner, it is also applicable to other types of magnetic toner having different development agents. Further, while the invention has been described in connection with the several foregoing specific examples, it can also be widely adapted to other types of image reproducing apparatus, including electrophotography, and will be particularly effective when applied to printers, copiers, facsimile machines or displays. Thus, the invention described herein is intended to embrace all such alternatives, modifications, applications and variations as fall within the spirit and scope of the appended claims.

What is claimed is:

1. A development apparatus for use in an image forming apparatus comprising:

a development member having a surface for the transport of a uniform layer of magnetic toner to a development region formed between said development member and a latent image carrier to develop a latent image formed on said latent image carrier, said development member comprising an elastic layer and a substantially continuous flexible magnetic field forming layer formed on said elastic layer.

2. The development apparatus of claim 1 wherein said development member is in pressure contact with said latent image carrier.

3. The development apparatus of claim 1 wherein said development member is positioned in proximity with the surface said latent image carrier.

4. The development apparatus of claim 3 wherein said development region is larger that the layer thickness of said magnetic toner formed on said development member.

5. The development apparatus of any one of the claims 1–4 wherein said development member includes a conductive layer.

6. The development apparatus of any one of the claims 1–4 wherein said development member includes an insulation layer.

7. The development apparatus of any one of the claims 1–4 wherein said development member includes a conductive layer and an insulating layer.

8. The development apparatus of claim 1 wherein the modulus of elasticity of said elastic layer relative to rubber hardness is under 70 degrees.

9. The development apparatus of claim 1 wherein the thickness of said elastic layer is over 0.5 mm.

10. The development apparatus of claim 1 wherein said development member has a surface roughness smaller than the smallest magnetic reverse interval of said magnetic field forming layer and is smaller than the bulk mean particle diameter of said magnetic toner.

11. The development apparatus of claim 1 wherein said development member comprises a roller, said roller including a conductive layer formed as the outer surface layer thereof for the transport of said magnetic toner, the surface roughness of said outer conductive layer being smaller than the smallest magnetic reverse interval of said magnetic field forming layer and smaller than the bulk means particle diameter of said toner.

12. The development apparatus of claim 1 wherein said latent image carrier and said development member are rotatably driven wherein the circumferential velocity of said development member is $V_d$ and the circumferential velocity of said latent image carrier is $V_p$, the ratio value of $V_d/V_p$ is greater than 1 and less than 5, and the smallest magnetic reverse interval of said magnetic field forming layer is below 500 μm.

13. The development apparatus of claim 1 includes biasing means to provide a development bias, $V_b$, between said latent image carrier and said development member in said development region, said biasing means including an alternating voltage bias to superimpose an alternating electric field in said development region.

14. The development apparatus of claim 13 wherein said development member further includes an conductive layer.

15. The development apparatus of claim 13 wherein said development member further includes an insulation layer.

16. The development apparatus of claim 1 wherein said development member comprises a tubular-shaped membrane member and a drive roller, said membrane member having at least a magnetic field forming layer, said membrane member having an ID that is greater than the OD of said drive roller, said drive roller engaging at least a portion of the inner surface of said tubular membrane member to rotate said membrane member in proximity to or engagement with said latent image carrier.

17. The development apparatus of claim 16 wherein said membrane member includes conductive layer.

18. The development apparatus of claim 16 wherein said membrane member includes an insulating layer.

19. The development apparatus of claim 16 wherein said membrane member includes a conductive layer and an insulation layer.

20. The development apparatus of claim 16 wherein the smallest magnetic reverse interval of said magnetic field forming layer is below 500 μm.

21. The development apparatus of claim 16 wherein the surface roughness of said development member is smaller than the smallest magnetic reverse interval of said magnetic field forming layer and smaller than the bulk mean particle diameter of said magnetic toner.

22. The development apparatus of claim 16 wherein said latent image carrier and said development member are rotatably driven wherein the circumferential velocity of said development member is $V_d$ and the circumferential velocity of said latent image carrier is $V_p$, the ratio value of $V_d/V_p$ is greater than 1 and less than 5, and the smallest magnetic reverse interval of said magnetic field forming layer is below 500 μm.

23. The development apparatus of claim 16 includes biasing means to provide a development bias, $V_b$, between said latent image carrier and said development member satisfying the expression:

$$\frac{|V_1 + V_2|}{2} \leqq |V_b| \leqq |V_2|$$

where $V_1$ is the electrical potential of the image portion formed on said latent image carrier, $V_2$ is the electrical potential of the non-image portion formed on said latent image carrier.

24. The development apparatus of claim 23 wherein said latent image carrier and said development member are in pressure contact with one other.

25. The development apparatus of claim 23 wherein the said latent image carrier and said development member are in contact with one other.

26. The development apparatus of claim 23 wherein said latent image carrier and said development member are spatially positioned to form a development gap therebetween.

27. The development apparatus of any one of the claims 23, 24, 25 and 26 wherein said development member includes a conductive layer and said development bias is applied to said conductive layer.

28. The development apparatus of claim 16 includes biasing means to provide a development bias, $V_b$, between said latent image carrier and said development member in said development region, said biasing means including an alternating voltage bias to superimpose an alternating electric field in said development region.

29. The development apparatus of claim 28 wherein said development member further includes a conductive layer.

30. The development apparatus of claim 28 wherein said development member further includes an insulation layer.

31. A development apparatus for use in an image forming apparatus comprising:

a development member having a surface for the transport of a uniform layer of magnetic toner to a development region formed between said development member and a latent image carrier to develop a latent image formed on said latent image carrier, said development member comprising an elastic layer and a substantially continuous flexible magnetic field forming layer formed on said elastic layer wherein the smallest magnetic reverse interval of said flexible magnetic field forming layer is below 500 μm.

32. A development apparatus for use in an image forming apparatus comprising:

a development member having a surface for the transport of a uniform layer of magnetic toner to a development region formed between said development member and a latent image carrier to develop a latent image formed on said latent image carrier, said development member comprising an elastic layer and a substantially continuous flexible magnetic field forming layer formed on said elastic layer; and biasing means for providing a development bias, $V_b$, between said latent image carrier and said development member satisfying the expression:

$$\frac{|V_1 + V_2|}{2} \leqq |V_b| \leqq |V_2|$$

where $V_1$ is the electrical potential of the image portion formed on said latent image carrier, $V_2$ is the electrical potential of the non-image portion formed on said latent image carrier.

33. The development apparatus of claim 32 wherein said latent image carrier and said development member are in pressure contact with one other.

34. The development apparatus of claim 32 wherein said latent image carrier and said development member are in contact with one other.

35. The development apparatus of claim 32 wherein said latent image carrier and said development member are spatially positioned to form a development gap therebetween.

36. The development apparatus of any one of the claims 32, 33, 34 and 35 wherein said development member includes a conductive layer and said development bias is applied to said conductive layer.

37. A development apparatus for use in connection with an image forming apparatus comprising:

a development member having a surface for the transport of a uniform layer of magnetic toner to a development region formed between said development member and a latent image carrier to develop a latent image formed on said latent image carrier, said development member comprising an elastic layer, a flexible magnetic field forming layer coated on said elastic layer having magnetic properties having a thickness substantially greater than said magnetic field forming layer, the thickness of said magnetic field forming layer being below 100 μm with a magnetic reverse pitch formed therein of under 500 μm, and the thickness of said elastic layer being over 0.5 mm.

38. The development apparatus of claim 37 wherein said development member includes a conductive layer formed between said elastic layer and said magnetic field forming layer, and bias means applied to said conductive layer to raise the development electrode effect of said development member.

39. The development apparatus of claim 37 wherein said development member includes a conductive layer formed on said magnetic field forming layer, bias means applied to said conductive layer to raise the development electrode effect of said development member, the surface roughness of said conductive layer being smaller than the smallest magnetic reverse interval of said magnetic field forming layer and smaller than the bulk mean particle diameter of said magnetic toner.

40. The development apparatus of claim 37 wherein said development member includes an insulating layer formed on said magnetic field forming layer controlling the charge polarity of and the amount of charge formed on said magnetic toner held on the surface of said development member.

41. The development apparatus of claim 37 wherein said development member includes a conductive layer formed on said magnetic field forming layer and an insulating layer formed on said conductive layer, and bias means applied to said conductive layer to raise the development electrode effect of said development member, said insulating layer controlling the charge polarity of and the amount of charge formed on said magnetic toner held on the surface of said development member.

42. The development apparatus of claim 37 wherein said development member includes a conductive layer formed on said elastic layer, said magnetic field forming layer formed on said conductive layer and an insulating layer formed on said magnetic field forming layer, and bias means applied to said conductive layer to raise the development electrode effect of said development member, said insulating layer controlling the charge polarity of and the amount of charge formed on said magnetic toner held on the surface of said development member.

43. A development apparatus for use in an image forming apparatus comprising:

a development member having a surface for the transport of a uniform layer of magnetic toner to a development region formed between said development member and a latent image carrier to develop a latent image formed on said latent image carrier, said development member comprises a membrane member supported on a drive roller, said membrane member having at least a flexible magnetic field forming layer with a magnetic reverse pitch under 500 μm, said membrane member having an ID that is greater than the OD of said drive roller, said drive roller having a frictional surface for engaging at least a portion of the inner surface of said membrane member to rotate said membrane member in proximity to or engagement with said latent image carrier.

44. The development apparatus of claim 43 wherein said development member includes a conductive layer formed on said magnetic field forming layer, and bias means applied to said conductive layer to raise the development electrode effect of said development member, the surface roughness of said conductive layer being smaller than the smallest magnetic reverse interval of said magnetic field forming layer and smaller than the bulk mean particle diameter of said magnetic toner.

45. The development apparatus of claim 43 wherein said development member includes an insulating layer formed on said magnetic field forming layer controlling the charge polarity of and the amount of charge formed on said magnetic toner held on the surface of said development member.

46. The development apparatus of claim 43 wherein said development member includes a conductive layer formed on said membrane layer, said magnetic field forming layer formed on said conductive layer and an insulating layer formed on said magnetic field forming layer, and bias means applied to said conductive layer to raise the development electrode effect of said development member, said insulating layer controlling the charge polarity of and the amount of charge formed on said magnetic toner held on the surface of said development member.

47. The development apparatus of claim 43 wherein said development member includes a conductive layer formed on said magnetic field forming layer and an insulating layer formed on said conductive layer, and bias means applied to said conductive layer to raise the development electrode effect of said development member, said insulating layer controlling the charge polarity of and the amount of charge formed on said magnetic toner held on the surface of said development member.

* * * * *